US005508728A

United States Patent [19]

Ishijima et al.

[11] Patent Number: 5,508,728

[45] Date of Patent: Apr. 16, 1996

[54] THERMAL HEAD DRIVING INTEGRATED CIRCUIT AND THERMAL HEAD DRIVING CIRCUIT USING THE SAME

[75] Inventors: Michio Ishijima; Masato Sakai; Mitsuhiko Fukuda, all of Kyoto, Japan

[73] Assignee: Rohm Co., Ltd.

[21] Appl. No.: 26,785

[22] Filed: Mar. 5, 1993

[30] Foreign Application Priority Data

Mar. 11, 1992 [JP] Japan ..... 4-052578

[51] Int. Cl.[6] ..... B41J 2/355

[52] U.S. Cl. ..... 347/211

[58] Field of Search ..... 347/180, 182, 347/211

[56] References Cited

U.S. PATENT DOCUMENTS 4,649,401 3/1987 Kojima et al. ..... 347/211

*Primary Examiner*—Huan H. Tran

*Attorney, Agent, or Firm*—Fish & Richardson

[57] ABSTRACT

In a thermal head driving integrated circuit, input serial data are converted into parallel data by a shift register. The ANDs of the parallel data obtained and a strobe signal is obtained, and transistors are driven in accordance with the ANDs. An input selection circuit determines the serial/parallel conversion timing and the transistor driving timing in accordance with the value input from select signal input terminals. The serial/parallel conversion timing and the transistor driving timing are constantly different from each other, so that latch circuits for latching the parallel data are obviated. The select signal input terminals are selectively pulled up/down.

61 Claims, 11 Drawing Sheets

THERMAL HEAD DRIVING INTEGRATED CIRCUIT AND THERMAL HEAD DRIVING CIRCUIT USING THE SAME

BACKGROUND OF THE INVENTION

1. Field of the Invention

The present invention relates to a thermal head driving integrated circuit (hereinunder referred to as "IC") and a thermal head driving circuit incorporating the same.

2. Description of the Related Art

Various printing machines such as a thermal printer or a facsimile machine for printing by heat are conventionally known. Such a machine is provided with a thermal head having a plurality of resistors for generating heat arranged in parallel. The resistors are heated when electric current is supplied to them. It is therefore possible to selectively heat a predetermined number of resistors by selectively supplying the current to the resistors. When a letter or the like is printed by using the thermal head, the resistors are heated under control in accordance with the shape of the letter or the like being printed.

The circuit for controlling the heating operation of the resistors, namely the thermal head driving circuit, is generally constituted by a thermal head driving IC. FIG. 11 shows the internal circuit of an example of a conventional thermal head driving IC.

The IC shown in FIG. 11 is provided with driving output terminals DO1 to DO64 which are connected to the corresponding resistors. In other words, the IC has a driving output of 64 bits. The data for controlling the output from the driving output terminals DO1 to DO64 to the resistors are serially input to the IC. For this purpose, the IC has a serial data input terminal SI.

The IC includes a shift register 10, latches for 64 bits 12, AND gates for 64 bits 14 and transistors for 64 bits 16. The shift register 10 is composed of, for example, 64 cascaded D flip-flops (not shown). The shift register 10 shifts the serial data input from the serial data input terminal SI in series in accordance with the clock and converts them into parallel data of 64 bits. The clock is input from a clock signal input terminal CLK. The symbol SO represents a serial data output terminal which is used when a plurality of the ICs shown in FIG. 11 are connected in cascade.

Each of the latches 12 latches the corresponding 1 bit from the parallel output supplied from the shift register 10 in accordance with the latch signal. The latch signal is input from a latch signal terminal LAT/$\overline{\text{LAT}}$ to each latch 12 through the exclusive OR (hereinunder referred to as "EOR") gate 18 which is formed within the IC.

One input of the EOR gate 18 is connected to the latch signal terminal LAT/$\overline{\text{LAT}}$, and the other input is pulled down within the IC and is connected to a control signal terminal CTL. It is therefore possible to determine whether each latch 12 should latch data in accordance with a positive latch signal LAT (what is called positive logical latch) or a negative latch signal $\overline{\text{LAT}}$ (what is called negative logical latch) by controlling the potential of the control signal terminal CTL by a control signal supplied from an external device to the IC.

The data latched by the latches 12 are input to the AND gates 14. To one terminal of each three-input AND gate 14, the corresponding bit is input from a latch 12. Strobe signals are input to the other two of input terminals. One of these input terminals is connected to a strobe signal terminal $\overline{\text{AEO}}$ through an inverter 20 and is pulled up within the IC. The other input terminal is connected to a strobe signal terminal BEO through a buffer 22 and is pulled down within the IC. By fixing the potential of either the strobe signal terminal $\overline{\text{AEO}}$ or the strobe signal terminal BEO and inputting a strobe signal from the other terminal, the user can select a low-level active mode or a high-level active mode.

The transistors 16 consist of 64 field-effect transistors (FETs). Alternatively, the transistors 16 may consist of bipolar transistors. The output terminal of each AND gate 14 is connected to the gate of the corresponding FET 16. The source and drain of each FET 16 are connected to the corresponding driving output terminal from DO1 to DO64 or the grounding terminals GND and GND2, respectively. In the case of using the IC shown in FIG. 11 for a thermal printer or the like, resistors (not shown) are connected between the driving output terminals DO1 to DO64 and the grounding terminals GND and GND2. An output voltage VH is applied to the resistors from a power source (not shown).

When a printing operation is carried out using this IC, data are first input serially from the serial data input terminal SI. The shift register 10 converts the data into parallel data. The parallel data obtained are latched by the latches 12 and output to the transistors 16 through the AND gates 14 as gate signals. The transistors 16 are selectively turned ON/OFF in accordance with the corresponding bits of the parallel data, and the voltage VH is selectively applied to the 64 resistors in accordance with the ON/OFF state of the transistors. In other words, the 64 resistors are selectively heated. Since the heating time is determined by the time during which the strobe signal is generated, the quantity of heat is controlled by the time during which the strobe signal is generated. In addition, since the latches 12 are inserted between the shift register 10 and the AND gates 14, the operation of inputting serial data to the IC and the operation of heating the resistors can be executed in parallel. High-speed operation is therefore possible.

The IC is provided with the serial data output terminal SO, so that it is possible to use a plurality of ICs as one block. For example, if the serial data output terminal SO of a first IC is connected to the serial data input terminal SI of a second IC, a block of outputs of 128 bits is composed.

In order to increase the printing speed, thermal heads are conventionally divided into a plurality of blocks and the printing operation is controlled in each block, thereby enabling parallel operation. In this case, the same number of strobe signals as the number of blocks are used. However, printing machines have recently demanded a reduction in the size of the IC and the circuit incorporating the IC while maintaining or enhancing the high-speed printing capacity. In the structure shown in FIG. 11, the latch group 12 is a hindrance to the reduction in the size of the IC and a circuit incorporating the IC. In addition, in the case of printing in blocks separately from each other by using a plurality of strobe signals, the external interface circuit becomes complicated.

SUMMARY OF THE INVENTION

Accordingly, it is an object of the present invention to eliminate the above-described problems in the related art and to provide a thermal head driving integrated circuit (hereinunder referred to as "IC") which obviates latches while maintaining the high-speed printing capacity. It is another object of the present invention to provide a thermal head driving circuit which needs only a single strobe signal and ICs having the same circuit structure in the case of printing in blocks separately from each other.

To achieve this aim, a thermal head driving IC according to the present invention comprises:

a) a plurality of select signal input terminals for inputting select signals;

b) a power supplying means for selectively supplying electric power to a plurality of resistors in accordance with supplied parallel data;

c) a serial/parallel converting means for converting input serial data into parallel data; and d) an input selecting means for permitting the serial/parallel conversion when the combination of the values input from the select signal input terminals is a first combination, and permitting the selective power supplying operation when the combination of the values input from the select signal input terminals is a second combination.

The thermal head driving IC according to the present invention is provided with a plurality of select signal input terminals. Select signals are input from these select signal input terminals. When the combination of the input values is the first combination, the input serial data are converted into parallel data, and when the combination of the input values is the second combination, the thermal resistors are heated. The serial/parallel conversion timing and the thermal resistor energizing timing are therefore different from each other and are determined in accordance with the values input from the select signal input terminals. It is not necessary to hold parallel data by a means such as a latch circuit. That is, the latch circuit is obviated, which leads to a reduction in the size of the IC.

The input selecting means may have various structures.

A first example of the input selecting means is provided with a means for generating a serial/parallel conversion permitting signal and supplying the signal to the serial/parallel converting means when the combination of the values input from the select signal input terminals is the first combination. The serial/parallel converting means executes the serial/parallel conversion only when the serial/parallel conversion permitting signal is supplied.

A second example of the input selecting means is provided with a means for generating a heating operation permitting signal and supplying the signal to the power supplying means when the combination of the values input from the select signal input terminals is the second combination. The power supplying means executes the selective power supplying operation only when the heating operation permitting signal is supplied.

In a third example of the input selecting means, the structure of the first example is combined with the structure of the second example.

When the third example is realized in the IC by providing two terminals as the select signal input terminals, the IC has the following structure:

a) the plurality of select signal input terminals include:

a1) a first select signal input terminal for inputting a first select signal; and a2) a second select signal input terminal for inputting a second select signal;

b) the input selecting means includes:

b1) a means for generating a heating operation permitting signal by obtaining the exclusive OR of the first select signal and the second select signal; and b2) a means for generating a serial/parallel conversion permitting signal by obtaining the logical NOT of the heating operation permitting signal;

c) the serial/parallel converting means executes the serial/parallel conversion only when the serial/parallel conversion permitting signal is supplied;

d) the power supplying means executes the selective power supplying operation only when the heating operation permitting signal is supplied; and e) the first combination and the second combination are mutually exclusive.

According to this structure, the heating operation permitting signal is generated as the exclusive OR of the first select signal and the second select signal, and the serial/parallel conversion permitting signal is generated as the logical NOT of the heating operation permitting signal. The selective power supplying (heating) operation is executed when the heating operation permitting signal is supplied and the serial/parallel conversion is executed when the serial/parallel conversion permitting signal is supplied. In other words, when the potential of the first select signal input terminal is equal to the potential of the second select signal input terminal, the IC executes the serial/parallel conversion, and when those potentials are different, the IC executes the heating operation.

This means that if either the first or the second select signal input terminal is fixed at a constant potential and a signal which alternates with a predetermined period is supplied to the other terminal, the serial/parallel conversion and the heating operation are alternately repeated in synchronism with the signal. At this time, if the potential at which one of the terminal is fixed is changed, the logic values of the heating operation permitting signal and the serial/parallel conversion permitting signal are inverted. Consequently, if the potential at which one of the terminals is fixed is appropriately set, it is possible to operate a plurality of ICs with different timings.

When the third example is realized in the IC by providing two terminals as the select signal input terminals, the IC may also have the following structure:

a) the plurality of select signal input terminals include:

a1) a first select signal input terminal for inputting a first select signal; and a2) a second select signal input terminal for inputting a second select signal b) the input selecting means includes:

b1) a means for generating a serial/parallel conversion permitting signal by obtaining the exclusive OR of the first select signal and the second select signal; and b2) a means for generating a heating operation permitting signal by obtaining the logical NOT of the serial/parallel conversion permitting signal;

c) the serial/parallel converting means executes the serial/parallel conversion only when the serial/parallel conversion permitting signal is supplied; and d) the power supplying means executes the selective power supplying operation only when the heating operation permitting signal is supplied.

According to this structure, the serial/parallel conversion permitting signal is generated as the exclusive OR of the first select signal and the second select signal, and the heating operation permitting signal is generated as the logical NOT of the serial/parallel conversion permitting signal. The selective power supplying (heating) operation is executed when the heating operation permitting signal is supplied and the serial/parallel conversion is executed when the serial/parallel conversion permitting signal is supplied. In other words, when the potential of the first select signal input terminal is equal to the potential of the second select signal input terminal, the IC executes the heating operation, and when those potentials are different, the IC executes the serial/parallel conversion.

This also means that if either the first or the second select signal input terminal is fixed at a constant potential and a signal which alternates with a predetermined period is supplied to the other terminal, the serial/parallel conversion and the heating operation are alternately repeated in synchronism with the signal. At this time, if the potential at which one of the terminal is fixed is changed, the logic levels of the heating operation permitting signal and the serial/parallel conversion permitting signal are inverted. Consequently, if the potential at which one of the terminals is appropriately set, it is possible to operate a plurality of ICs with different timings.

When the third example is realized in the IC by providing four terminals as the select signal input terminals, the IC has the following structure:

a) the plurality of select signal input terminals include:

a1) a first select signal input terminal for inputting a first select signal;

a2) a second select signal input terminal for inputting a second select signal;

a3) a third select signal input terminal for inputting a third select signal; and a4) a fourth select signal input terminal for inputting a fourth select signal;

b) the input selecting means includes:

b1) a means for generating a serial/parallel conversion permitting signal by obtaining the exclusive OR of the first select signal and the second select signal;

b2) a means for generating a first heating operation permitting signal by obtaining the logical NOT of the serial/parallel conversion permitting signal; and b3) a means for generating a second heating operation permitting signal by obtaining the logical NOT of the third select signal and the fourth select signal;

c) the serial/parallel converting means executes the serial/parallel conversion only when the serial/parallel conversion permitting signal is supplied; and d) the power supplying means executes the selective power supplying operation only when both the first heating operation permitting signal and the second heating operation permitting signal are supplied.

According to this structure, the serial/parallel conversion permitting signal is generated as the exclusive OR of the first select signal and the second select signal, the first heating operation permitting signal is generated as the logical NOT of the serial/parallel conversion permitting signal, and the second heating operation permitting signal is generated as the exclusive OR of the third select signal and the fourth select signal. The serial/parallel conversion is executed when the serial/parallel conversion permitting signal is supplied, and the selective power supplying (heating) operation is executed when the first and the second heating operation permitting signals are supplied. In other words, when the potential of the first select signal input terminal is different from the potential of the second select signal input terminal, the IC executes the serial/parallel conversion. When the potential of the first select signal input terminal is equal to the potential of the second select signal input terminal and the potential of the third select signal input terminal is different from the potential of the fourth select signal input terminal, the IC executes the heating operation.

This means that if either the first or the second select signal input terminal is fixed at a constant potential and a signal which alternates with a predetermined period is supplied to the other terminal, the serial/parallel conversion is executed in synchronism with the signal. If either the third or the fourth select signal input terminal is fixed at a constant potential and a signal which alternates with a predetermined period is supplied to the other terminal, the heating operation is executed when the values of the third and the fourth select signals are different from each other during the period in which the serial/parallel conversion is not executed. Consequently, the serial/parallel conversion timing and the resistor heating timing are always different from each other in the same way as in the case of realizing the third example in the IC by providing two terminals as the select signal input terminals. At this time, if the potentials at which the terminals are fixed are changed, the logic levels of the heating operation permitting signal and the serial/parallel conversion permitting signal are inverted. Consequently, if the potentials at which the terminals are fixed are appropriately set, it is possible to operate a plurality of ICs with different timings in the respective blocks. Since the number of select signal input terminals is larger as compared with the IC using two terminals as the select signal input terminals, the number of blocks may be increased.

When the third example is realized in the IC by providing four terminals as the select signal input terminals, the IC may also have the following structure:

a) the plurality of select signal input terminals include:

a1) a first select signal input terminal for inputting a first select signal; and a2) a second select signal input terminal for inputting a second select signal;

a3) a plurality of third select signal input terminals for inputting a plurality of third select signals; and a4) a plurality of fourth select signal input terminal for inputting a plurality of fourth select signals;

b) the input selecting means includes:

b1) a means for generating a serial/parallel conversion permitting signal by obtaining the exclusive OR of the first select signal and the second select signal;

b2) a means for generating a first heating operation permitting signal by obtaining the logical NOT of the serial/parallel conversion permitting signal; and b3) a means for generating a second heating operation permitting signal when the combination of the plurality of third select signals and the plurality of fourth select signals is a predetermined combination;

c) the serial/parallel converting means executes the serial/parallel conversion only when the serial/parallel conversion permitting signal is supplied; and d) the power supplying means executes the selective power supplying operation only when both the first heating operation permitting signal and the second heating operation permitting signal are supplied.

According to this structure, the serial/parallel conversion permitting signal is generated as the exclusive OR of the first select signal and the second select signal, the first heating operation permitting signal is generated as the logical NOT of the serial/parallel conversion permitting signal, and the second heating operation permitting signal is generated as the result of the judgement of the combination of the third select signals and the fourth select signals. The serial/parallel conversion is executed when the serial/parallel conversion permitting signal is supplied, and the selective power supplying (heating) operation is executed when the first and the second heating operation permitting signals are supplied. In other words, when the potential of the first select signal input terminal is different from the potential of the second select signal input terminal, the IC executes the serial/parallel conversion. When the potential of the first select signal input terminal is equal to the potential of the second select signal input terminal and the combination of the potentials of the third select signal input terminals and the potentials of the fourth select signal input terminals is a predetermined combination, the IC executes the heating operation.

This also means that if either the first or the second select signal input terminal is fixed at a constant potential and a signal which alternates with a predetermined period is supplied to the other terminal, the serial/parallel conversion is executed in synchronism with the signal. If either the third or the fourth select signal input terminals are fixed at constant potentials and a signal which alternates with a predetermined period is supplied to the other terminals, the heating operation is executed when the combination of the values of the third and the fourth select signals is a predetermined combination during the period in which the serial/parallel conversion is not executed. Consequently, the serial/parallel conversion timing and the resistor heating timing are always different from each other in the same way as in the case of realizing the third example in the IC by providing two terminals as the select signal input terminals. At this time, if the potentials at which the terminals are fixed are changed, the logic levels of the heating operation permitting signal and the serial/parallel conversion permitting signal are inverted. Consequently, if the potentials at which the terminals are fixed are appropriately set, it is possible to operate a plurality of ICs with different timings in the respective blocks. Since the number of select signal input terminals is much larger compared with the IC using two terminals as the select signal input terminals, the number of blocks may be increased.

When the third example is realized in the IC by providing one terminal as the select signal input terminal, the IC has the following structure:

a) the plurality of select signal input terminals include a first select signal input terminal for inputting a first select signal;

b) the input selecting means includes:

b1) a means for generating a serial/parallel conversion permitting signal by obtaining the exclusive OR of the first select signal and a first fixed value; and b2) a means for generating a heating operation permitting signal by obtaining the logical NOT of the serial/parallel conversion permitting signal;

c) the serial/parallel converting means executes the conversion only when the serial/parallel conversion permitting signal is supplied; and d) the power supplying means executes the selective power supplying operation only when the heating operation permitting signal is supplied.

According to this structure, the serial/parallel conversion permitting signal is generated as the exclusive OR of the first select signal and the first fixed value, and the heating operation permitting signal is generated as the logical NOT of the serial/parallel conversion permitting signal. The serial/parallel conversion is executed when the serial/parallel conversion permitting signal is supplied and the selective power supplying (heating) operation is executed when the heating operation permitting signal is supplied. In other words, when the potential of the first select signal input terminal is different from the first fixed value, the IC executes the serial/parallel conversion, and when the potential of the first select signal input terminal is equal to the first fixed value, the IC executes the heating operation.

This means that when a signal which alternates with a predetermined period is supplied to the first select signal input terminal, the serial/parallel conversion is executed in synchronism with the signal. It also means that the heating operation permitting signal is generated in inverted phase, and the heating operation is executed with a different timing from that of the serial/parallel conversion. Consequently, the serial/parallel conversion timing and the resistor heating timing are always different from each other in the same way as in the case of realizing the third example in the IC by providing two terminals as the select signal input terminals.

When the third example is realized in the IC by providing two terminals as the select signal input terminal by utilizing the structure for using one select signal input terminal in the third example, the IC has the following structure:

a) the plurality of select signal input terminals include:

a1) a first select signal input terminal for inputting a first select signal; and a2) a second select signal input terminal for inputting a second select signal;

b) the input selecting means includes:

b1) a means for generating a serial/parallel conversion permitting signal by obtaining the exclusive OR of the first select signal and a first fixed value;

b2) a means for generating a first heating operation permitting signal by obtaining the logical NOT of the serial/parallel conversion permitting signal; and b3) a means for generating a second heating operation permitting signal by obtaining the exclusive OR of the second select signal and a second fixed value;

c) the serial/parallel converting means executes the serial/parallel conversion only when the serial/parallel conversion permitting signal is supplied; and d) the power supplying means executes the selective power supplying operation only when both the first heating operation permitting signal and the second heating operation permitting signal are supplied.

According to this structure, the serial/parallel conversion permitting signal is generated as the exclusive OR of the first select signal and the first fixed value, the heating operation permitting signal is generated as the logical NOT of the serial/parallel conversion permitting signal, and the second heating operation permitting signal is generated as the exclusive OR of the second select signal and the second fixed value. The serial/parallel conversion is executed when the serial/parallel conversion permitting signal is supplied and the selective power supplying (heating) operation is executed when the first heating operation permitting signal and the second heating operation permitting signal are supplied. In other words, when the potential of the first select signal input terminal is different from the first fixed value, the IC executes the serial/parallel conversion, and when the potential of the first select signal input terminal is equal to the first fixed value and the potential of the second select signal input terminal is different from the second fixed value, the IC executes the heating operation.

This means that when a signal which alternates with a predetermined period is supplied to the first select signal input terminal, the serial/parallel conversion is executed in synchronism with the signal. It also means that the first heating operation permitting signal is generated in inverted phase, and the heating operation is executed with a different timing from that of the serial/parallel conversion.

Consequently, the serial/parallel conversion timing and the resistor heating timing are always different from each other in the same way as in the case of realizing the third example in the IC by providing two terminals as the select signal input terminals. In addition, since the second heating operation permitting signal is generated by using the potential of the second select signal input terminal, it is possible to operate a plurality of ICs with different timings in the respective blocks.

The fixed value which is the object of the exclusive OR of the first select signal or the second select signal is supplied as a pullup resistance.

A thermal head driving IC of the present invention may also comprise:

a) a plurality of select signal input terminals for inputting select signals;

b) a serial data input terminal for inputting serial data;

c) a clock signal input terminal for inputting a clock signal;

d) a strobe signal input terminal for inputting a strobe signal;

e) a power supplying means for selectively supplying electric power to a plurality of resistors in accordance with supplied parallel data, the means including:

e1) a plurality of AND gates for obtaining the logical ANDs, of respective bits of parallel data which are obtained from a shift register and the strobe signal only when the selective power supplying operation is permitted by an input selecting means; and e2) a plurality of driving elements which are provided in correspondence with the plurality of resistors and which are controlled by the ANDs obtained by the AND gates;

f) a serial/parallel converting means for converting input serial data into parallel data only when the serial/parallel converting operation is permitted by the input selecting means; the serial/parallel converting means including the shift register for converting the serial data, which are input from an external device to the IC through a serial data input terminal, into the parallel data by bit-shifting the serial data in accordance with the clock signal, and supplying the parallel data to the power supplying means; and g) the input selecting means for permitting the serial/parallel converting operation of the serial/parallel converting means when the combination of the values input from the select signal input terminals is a first combination, and permitting the selective power supplying operation of the power supplying means when the combination of the values input from the select signal input terminals is a second combination.

According to this structure, when the combination of the input values is a first combination, the input serial data are converted into parallel data, and when the combination of the input values is a second combination, the resistors are heated in the same way as in the thermal head driving IC provided in the first aspect of the present invention. It is therefore not necessary to hold parallel data by a means such as a latch circuit. That is, the latch circuit is obviated, which leads to a reduction in the size of the circuit. In addition, since the only function of the strobe signal is determination of the heating (printing) time, only one kind of strobe signal is needed if a plurality of ICs are driven with different timings. As a result, the external interface is simplified.

This IC may also have various structures depending upon the operational logic of the input selecting means.

In a first example of the structure of the IC, a) the plurality of select signal input terminals include:

a1) a first select signal input terminal for inputting a first select signal; and a2) a second select signal input terminal for inputting a second select signal; and b) the input selecting means includes:

b1) a means for generating a heating operation permitting signal by obtaining the exclusive OR of the first select signal and the second select signal;

b2) a heating operation permitting means for permitting the selective power supplying operation of the power supplying means by gating the strobe signal in accordance with the heating operation permitting signal and supplying the gated strobe signal to the power supplying means;

b3) a means for generating a serial/parallel conversion permitting signal by obtaining the logical NOT of the heating operation permitting signal; and b4) a serial/parallel conversion permitting means for permitting the serial/parallel conversion of the serial/parallel converting means by gating the clock signal in accordance with the serial/parallel conversion permitting signal and supplying the gated clock signal to the serial/parallel converting means.

In a second example of the structure of the IC, a) the plurality of select signal input terminals include:

a1) a first select signal input terminal for inputting a first select signal; and a2) a second select signal input terminal for inputting a second select signal;

b) the input selecting means includes:

b1) a means for generating a serial/parallel conversion permitting signal signal by obtaining the exclusive OR of the first select signal and the second select signal;

b2) a serial/parallel conversion permitting means for permitting the serial/parallel conversion of the serial/parallel converting means by gating the clock signal in accordance with the serial/parallel conversion permitting signal and supplying the gated clock signal to the serial/parallel converting means; and b3) a means for generating a heating operation permitting signal by obtaining logical NOT of the serial/parallel conversion permitting signal;

c) the serial/parallel converting means executes the conversion only when the serial/parallel conversion permitting signal is supplied; and d) the power supplying means executes the selective power supplying operation only when the heating operation permitting signal is supplied.

In a third example of the structure of the IC, a) the plurality of select signal input terminals include:

a1) a first select signal input terminal for inputting a first select signal;

a2) a second select signal input terminal for inputting a second select signal;

a3) a third select signal input terminal for inputting a third select signal; and a4) a fourth select signal input terminal for inputting a fourth select signal;

b) the input selecting means includes:

b1) a means for generating a serial/parallel conversion permitting signal by obtaining the exclusive OR of the first select signal and the second select signal;

b2) a serial/parallel conversion permitting means for permitting the serial/ parallel conversion of the serial/ parallel converting means by gating the clock signal in accordance with the serial/parallel conversion permitting signal and supplying the gated clock signal to the serial/parallel converting means;

b3) a means for generating a first heating operation permitting signal by obtaining the logical NOT of the serial/parallel conversion permitting signal;

b4) a means for generating a second heating operation permitting signal by obtaining the logical NOT of the third select signal and the fourth select signal; and b5) a heating operation permitting means for permitting the selective power supplying operation of the power supplying means by gating the strobe signal in accordance with the first heating operation permitting signal and the second heating operation permitting signal and supplying the gated strobe signal to the power supplying means;

c) the serial/parallel converting means executes the conversion only when the serial/parallel conversion permitting signal is supplied; and d) the power supplying means executes the selective power supplying operation only when both the first heating operation permitting signal and the second heating operation permitting signal are supplied.

In a fourth example of the structure of the IC, a) the plurality of select signal input terminals include:

a1) a first select signal input terminal for inputting a first select signal;

a2) a second select signal input terminal for inputting a second select signal;

a3) a plurality of third select signal input terminals for inputting a plurality of third select signals; and a4) a plurality of fourth select signal input terminals for inputting a plurality of fourth select signals;

b) the input selecting means includes:

b1) a means for generating a serial/parallel conversion permitting signal by obtaining the exclusive OR of the first select signal and the second select signal;

b2) a serial/parallel conversion permitting means for permitting the serial/parallel conversion of the serial/parallel converting means by gating the clock signal in accordance with the serial/parallel conversion permitting signal and supplying the gated clock signal to the serial/parallel converting means;

b3) a means for generating a first heating operation permitting signal by obtaining the logical NOT of the serial/parallel conversion permitting signal;

b4) a means for generating a second heating operation permitting signal when the combination of the plurality of third select signals and the plurality of fourth select signals is a predetermined combination; and b5) a power supplying operation permitting means for permitting the selective power supplying operation of the power supplying means by gating the strobe signal in accordance with the first heating operation permitting signal and the second heating operation permitting signal and supplying the gated strobe signal to the power supplying means;

c) the power supplying means executes the selective power supplying operation only when both the first heating operation permitting signal and the second heating operation permitting signal are supplied.

In a fifth example of the structure of the IC, a) the plurality of select signal input terminals include a first select signal input terminal for inputting a first select signal;

b) the input selecting means includes:

b1) a means for generating a serial/parallel conversion permitting signal by obtaining the exclusive OR of the first select signal and a first fixed value;

b2) a serial/parallel conversion permitting means for permitting the serial/parallel conversion of the serial/parallel converting means by gating the clock signal in accordance with the serial/parallel conversion permitting signal and supplying the gated clock signal to the serial/parallel converting means; and b3) a means for generating a first heating operation permitting signal by obtaining the logical NOT of the serial/parallel conversion permitting signal;

c) the serial/parallel converting means executes the conversion only when the serial/parallel conversion permitting signal is supplied; and d) the power supplying means executes the selective power supplying operation only when the first heating operation permitting signal is supplied.

In a sixth example of the structure of the IC, a) the plurality of select signal input terminals include:

a1) a first select signal input terminal for inputting a first select signal; and a2) a second select signal input terminal for inputting a second select signal;

b) the input selecting means includes:

b1) a means for generating a serial/parallel conversion permitting signal by obtaining the exclusive OR of the first select signal and a first fixed value;

b2) a serial/parallel conversion permitting means for permitting the serial/parallel conversion of the serial/parallel converting means by gating the clock signal in accordance with the serial/parallel conversion permitting signal and supplying the gated clock signal to the serial/parallel converting means;

b3) a means for generating a first heating operation permitting signal by obtaining the logical NOT of the serial/parallel conversion permitting signal;

b4) a means for generating a second heating operation permitting signal by obtaining the exclusive OR of the second select signal and a second fixed value; and b5) a power supplying operation permitting means for permitting the selective power supplying operation of the power supplying means by gating the strobe signal in accordance with the first heating operation permitting signal and the second heating operation permitting signal and supplying the gated strobe signal to the energizing means;

c) the serial/parallel converting means executes the conversion only when the serial/parallel conversion permitting signal is supplied; and d) the power supplying means executes the selective power supplying operation only when both the first heating operation permitting signal and the second heating operation permitting signal are supplied.

As the driving elements, transistors are usable. The driving elements and the resistors are connected through a plurality of output terminals. If there is provided a serial output terminal for outputting externally from the IC the serial data which overflow the shift register as a result of bit shifting by the shift register, printing in blocks separately from each other can preferably be realized. In addition, if the potential of at least one of the select signal input terminals is fixed within the IC, pullup outside of the IC can be omitted.

A thermal head driving circuit according to the present invention is provided with a plurality of thermal head driving ICs, each thermal head driving IC comprising:

a) a plurality of select signal input terminals for inputting select signals;

b) a power supplying means for selectively supplying electric power to a plurality of resistors in accordance with supplied parallel data;

c) a serial/parallel converting means for converting input serial data into parallel data; and d) an input selecting means for permitting the serial/parallel conversion of the serial/parallel converting means when the combination of the values input from the select signal input terminals is a first combination, and permitting the selective power supplying operation of the power supplying means when the combination of the values input from the select signal input terminals is a second combination;

wherein at least one thermal head driving IC is allotted to each of a plurality of blocks each of which is composed of a plurality of resistors, and each thermal head driving IC controls the selective power supplying operation to at least some of the resistors in the corresponding block;

the select signal input terminals of each thermal head driving IC are divided into at least two groups;

the select signal input terminals of a first group are fixed at a predetermined potential pattern; the potential pattern being set different in blocks; and a second group including only the select signal input terminals which do not belong to the first group inputs a predetermined number of select signals.

This circuit is used for the purpose of printing a plurality of blocks separately from each other. The select signal input terminals of the first group are fixed at the predetermined potential pattern different in blocks (by, for example, pullup and/or pulldown), and the other select signal input terminals supply a predetermined number of select signals. Therefore, the structure of each of the ICs may be one and the same.

This circuit may have various structures.

In a first example of the thermal head driving circuit, each IC is provided with the input selecting means including a means for generating the serial/parallel conversion permitting signal and supplying the serial/parallel conversion permitting signal to the corresponding serial/parallel converting means when the combination of the values input from the corresponding select signal input terminals is a first combination. In this case, each serial/parallel converting means executes the serial/parallel conversion only when the serial/parallel conversion permitting signal is supplied from the corresponding input selecting means.

In a second example of the thermal head driving circuit, each IC is provided with the input selecting means including a means for generating the heating operation permitting signal and supplying the heating operation permitting signal to the corresponding power supplying means when the combination of the values input from the corresponding select signal input terminals is a second combination. In this case, each power supplying means executes the selective power supplying operation only when the heating operation permitting signal is supplied from the corresponding input selecting means.

A third example is a combination of the first example and the second example.

In order to realize the present invention as a thermal head driving circuit, the structure of terminals is important. For example, each IC includes:

a) a serial data input terminal for inputting serial data;

b) a clock signal input terminal for inputting a clock signal;

c) a strobe signal input terminal for inputting a strobe signal to the energizing means;

d) a serial output terminal for outputting serial data externally from the IC; and e) a plurality of output terminals through which the power supplying means selectively supplies electric power to the resistors.

According to this structure, each serial/parallel converting means converts the serial data, which are input from the corresponding serial data input terminal, into parallel data and outputs overflowing serial data externally from the corresponding serial output terminal. Each serial/parallel converting means executes the serial/parallel conversion only when the serial/parallel conversion is permitted by the corresponding input selecting means. Each power supplying means supplies electric power to the resistors which are designated by the parallel data supplied from the corresponding serial/parallel converting means, through the corresponding output terminals during the period which is designated by the strobe signal input from the corresponding strobe signal input terminal. Each power supplying means executes the selective power supplying operation only when the heating operation is permitted by the corresponding selecting means.

There are various kinds of logic which can be used for the input selection, namely, the structure of the input selecting means can be variably constructed.

In a first example of the structure, a) the plurality of select signal input terminals in each IC include:

a1) a first select signal input terminal for inputting a first select signal; and a2) a second select signal input terminal for inputting a second select signal;

b) the input selecting means in each IC includes:

b1) a means for generating a heating operation permitting signal by obtaining the exclusive OR of the first select signal and the second select signal;

b2) a heating operation permitting means for permitting the selective power supplying operation of the power supplying means by gating the strobe signal in accordance with the heating operation permitting signal supplied from the heating operation permitting signal generating means in the IC and supplying the gated strobe signal to the power supplying means in the IC;

b3) a means for generating a serial/parallel conversion permitting signal by obtaining the logical NOT of the heating operation permitting signal supplied from the heating operation permitting signal generating means in the IC; and b4) a serial/parallel conversion permitting means for permitting the serial/parallel conversion of the serial/parallel converting means by gating the clock signal in accordance with the serial/parallel conversion permitting signal supplied from the serial/parallel conversion permitting signal generating means in the IC and supplying the gated clock signal to the serial/parallel converting means in the IC.

In the case of adopting this structure, the potential of the first selection signal input terminal in each IC is fixed at a potential different for each block. The second select signal input terminals in the thermal head driving circuit, the clock signal input terminal in the circuit and the strobe signal input terminal in the circuit are respectively connected in common. Therefore, the same select signal, clock signal and strobe signal are supplied to each of the ICs in the circuit. Furthermore, by connecting the serial data output terminal of a preceding IC to the serial data input terminal of the subsequent IC, the ICs allotted to the same block are cascaded. The IC cascades which are allotted to different blocks are connected in parallel by connecting the serial data input terminals of the foremost ICs of the respective cascades.

In this manner, the serial/parallel conversion and the heating operation of the resistors are alternately executed in each block. On the other hand, the execution timings in one block are different from those in other blocks. For example, while the serial/parallel conversion is executed in a first block, heating operation of the resistors is executed in a second block.

The potential of the select signal input terminal in each IC may be fixed by either pullup or pulldown.

In a second example of the structure, a) the plurality of select signal input terminals of each IC include:

a1) a first select signal input terminal for inputting a first select signal;

a2) a second select signal input terminal for inputting a second select signal;

a3) a third select signal input terminal for inputting a third select signal; and a4) a fourth select signal input terminal for inputting a fourth select signal;

b) the input selecting means in each IC includes:

b1) a means for generating a serial/parallel conversion permitting signal by obtaining the exclusive OR of the first select signal and the second select signal;

b2) a serial/parallel conversion permitting means for permitting the serial/parallel conversion of the serial/parallel converting means by gating the clock signal in accordance with the serial/parallel conversion permitting signal supplied from the serial/parallel converting means in the IC and supplying the gated clock signal to the serial/parallel converting means in the IC;

b3) a means for generating a first heating operation permitting signal by obtaining the logical NOT of the serial/parallel conversion permitting signal supplied from the serial/parallel converting means in the IC;

b4) a means for generating a second heating operation permitting signal by obtaining the logical NOT of the third select signal and the fourth select signal; and b5) a heating operation permitting means for permitting the selective power supplying operation of the power supplying means by gating the strobe signal in accordance with the first heating operation permitting signal and the second heating operation permitting signal and supplying the gated strobe signal to the power supplying means in the IC;

c) the serial/parallel converting means in each IC executes the serial/parallel conversion only when the serial/parallel conversion is permitted by the serial/parallel conversion permitting means in the IC; and d) the power supplying means in each IC executes the selective power supplying operation only when the heating operation is permitted by the heating operation permitting means in the IC.

In the case of adopting this structure, the potentials of the first selection signal input terminal and the third select signal input terminal in each IC are fixed at different potentials for each block. The second select signal input terminals in the thermal head driving circuit, the fourth select signal input terminals in the circuit, the clock signal input terminals in the circuit and the strobe signal input terminals in the circuit are respectively connected in common. Furthermore, by connecting the serial data output terminal of a preceding IC to the serial data input terminal of the subsequent IC, the ICs allotted to the same block are cascaded. The IC cascades which are allotted to different blocks and which have the first select signal input terminals fixed at an equal potential are cascaded by connecting the serial output terminal of the IC at the last stage of the precedent cascade to the serial input terminal of the IC at the foremost stage of the subsequent cascade. The IC cascades which are allotted to different blocks and which have the first select signal input terminals fixed at different potentials are connected in parallel by connecting the serial data input terminals of the foremost ICs of the respective cascades.

In this manner, the serial/parallel conversion and the heating operation of the resistors are alternately executed in each block. On the other hand, the execution timings in one block are different from those in other blocks. For example, while the serial/parallel conversion is executed in the first and the second blocks, heating operation of the resistors is executed in the third and the fourth blocks. In addition, in the blocks (e.g., third and fourth blocks) in which the same operation (e.g., heating) is executed, the operational timings (e.g., heating timings) are different between one block (e.g., third block) and the other (e.g., fourth block) .

In a third example of the structure, a) the plurality of select signal input terminals in each IC include:

a1) a first select signal input terminal for inputting a first select signal;

a2) a second select signal input terminal for inputting a second select signal;

a3) a plurality of third select signal input terminals for inputting a plurality of third select signals; and a4) a plurality of fourth select signal input terminals for inputting a plurality of fourth select signals;

b) the input selecting means in each IC includes:

b1) a means for generating a serial/parallel conversion permitting signal by obtaining the exclusive OR of the first select signal and the second select signal;

b2) a serial/parallel conversion permitting means for permitting the serial/parallel conversion of the serial/parallel converting means by gating the clock signal in accordance with the serial/parallel conversion permitting signal supplied from the serial/parallel converting means in the IC and supplying the gated clock signal to the serial/parallel converting means in the IC;

b3) a means for generating a first heating operation permitting signal by obtaining the logical NOT of the serial/parallel conversion permitting signal supplied from the serial/parallel converting means in the IC;

b4) a means for generating a second heating operation permitting signal when the combination of the plurality of third select signals and the plurality of fourth select signals is a predetermined combination; and b5) a heating operation permitting means for permitting the selective power supplying operation of the power supplying means by gating the strobe signal in accordance with the first heating operation permitting signal and the second heating operation permitting signal and supplying the gated strobe signal to the power supplying means in the IC;

c) the serial/parallel converting means in each IC executes the serial/parallel conversion only when the serial/parallel conversion is permitted by the serial/parallel conversion permitting means in the IC; and d) the power supplying means in each IC executes the selective power supplying operation only when the selective power supplying operation is permitted by the heating operation permitting means in the IC.

When this structure is adopted, external connection is used in the same way as in the second example. In this manner, the serial/parallel conversion and the heating operation of the resistors are alternately executed in each block. On the other hand, the execution timings in one block are different from those in other blocks. For example, while the serial/parallel conversion is executed in the first and the second blocks, heating operation of the resistors is executed in the third and the fourth blocks. In addition, in the blocks in which the same operation is executed, the operational timings are different between one block and the other. The number of blocks is not restricted to four.

In a fourth example of the structure, a) the plurality of select signal input terminals in each IC include:

a1) a first select signal input terminal for inputting a first select signal; and a2) a second select signal input terminal for inputting a second select signal;

b) the input selecting means in each IC includes:

b1) a means for generating a serial/parallel conversion permitting signal by obtaining the exclusive OR of the first select signal and a first fixed value;

b2) a serial/parallel conversion permitting means for permitting the serial/parallel conversion of the serial/parallel converting means by gating the clock signal in accordance with the serial/parallel conversion permitting signal supplied from the serial/parallel converting means in the IC and supplying the gated clock signal to the serial/parallel converting means in the IC;

b3) a means for generating a first heating operation permitting signal by obtaining the logical NOT of the serial/parallel conversion permitting signal supplied from the serial/parallel converting means in the IC;

b4) a means for generating a second heating operation permitting signal by obtaining the exclusive OR of the second select signal and a second fixed value; and b5) a heating operation permitting means for permitting the selective power supplying operation of the power supplying means by gating the strobe signal in accordance with the first heating operation permitting signal and the second heating operation permitting signal supplied from the first heating operation permitting signal generating means and the second heating operation permitting signal generating means in the IC and supplying the gated strobe signal to the power supplying means in the IC;

c) the serial/parallel converting means in each IC executes the serial/parallel conversion only when the serial/parallel conversion is permitted by the serial/parallel conversion permitting means in the IC; and d) the power supplying means in each IC executes the selective power supplying operation only when the selective power supplying operation is permitted by the heating operation permitting means in the IC.

When this structure is adopted, external connection is used in the same way as in the second example. In this manner, serial/parallel conversion and heating operation of the resistors are alternately executed in each block. On the other hand, the execution timings in one block are different from those in other blocks. For example, while the serial/parallel conversion is executed in the first and the second blocks, heating operation of the resistors is executed in the third and fourth blocks. In addition, in the blocks in which the same operation is executed, the operational timings are different between one block and the other.

A thermal head according to the present invention comprises:

a) a plurality of resistors; and b) a plurality of thermal head driving integrated circuits; wherein each integrated circuit includes:

b1) a plurality of select signal input terminals for inputting select signals;

b2) a power supplying means for selectively supplying electric power to a plurality of resistors in accordance with supplied parallel data;

b3) a serial/parallel converting means for converting input serial data into parallel data; and b4) an input selecting means for permitting the serial/parallel conversion of the serial/parallel converting means when the combination of the values input from the select signal input terminals is a first combination, and permitting the selective power supplying operation of the power supplying means when the combination of the values input from the select signal input terminals is a second combination;

at least one thermal head driving IC is allotted to each of a plurality of blocks each of which is composed of a plurality of resistors, and each thermal head driving IC controls the selective power supplying operation of at least some of the resistors in the corresponding block;

the select signal input terminals of each thermal head driving IC are divided into at least two groups;

the select signal input terminals of a first group are fixed at a potential different for each block; and a second group including only the select signal input terminals which do not belong to the first group inputs a select signal.

That is, a thermal head according to the present invention comprises a thermal head driving circuit in accordance with the present invention and resistors to which the thermal head driving circuit of the present invention supplies a power so as to heat them. Consequently, a small-sized and high-speed printing thermal head is realized due to the thermal head driving circuit of the present invention.

The above and other objects, features and advantages of the present invention will become clear from the following description of the preferred embodiments thereof, taken in conjunction with the accompanying drawings.

DESCRIPTION OF THE PREFERRED EMBODIMENTS

The preferred embodiments of the present invention will be explained hereinunder. The same numerals are provided for the elements which are the same as those in the conventional example shown in FIG. 11, and explanation thereof will be omitted.

Figure 1:
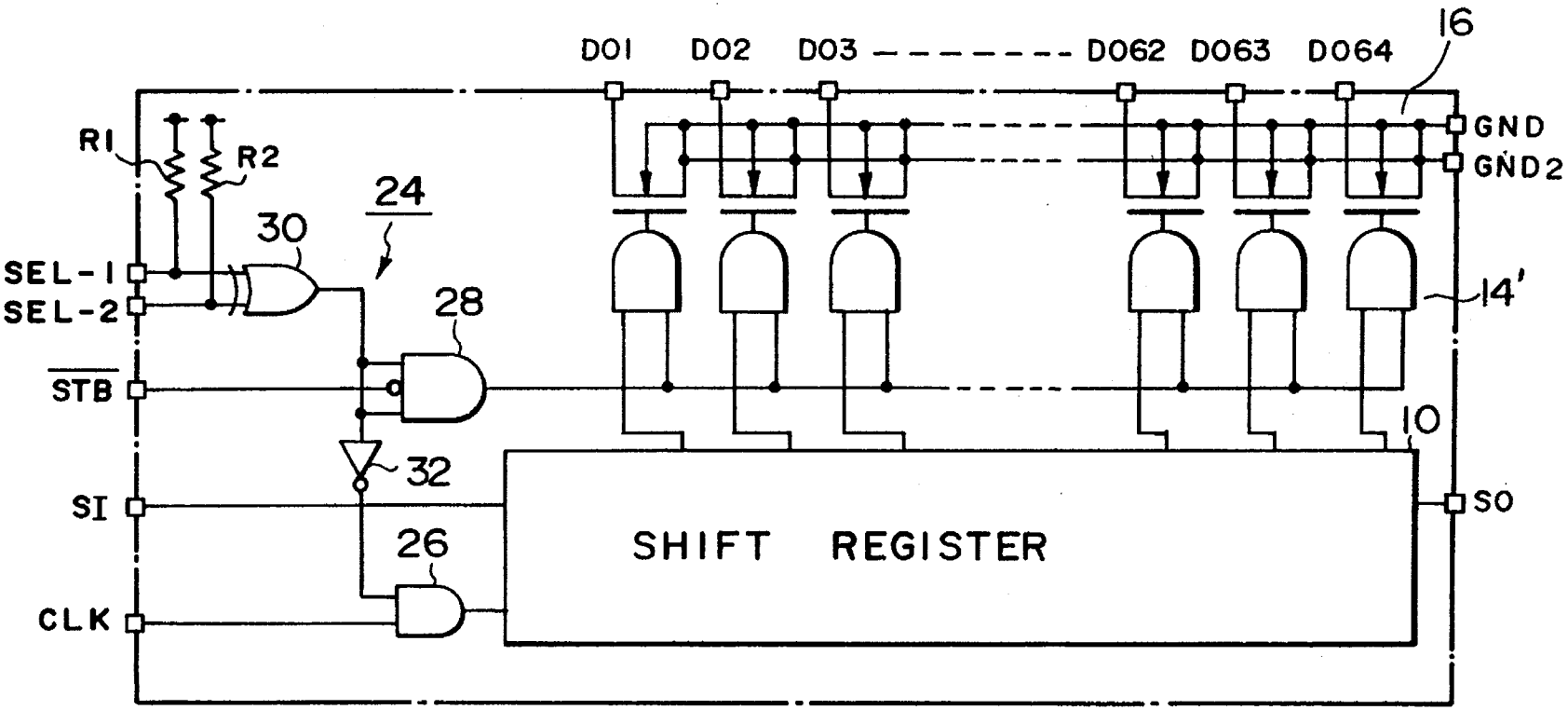
FIG. 1 is a circuit diagram showing the structure of a first embodiment of a thermal head driving IC according to the present invention.
Figure 11:
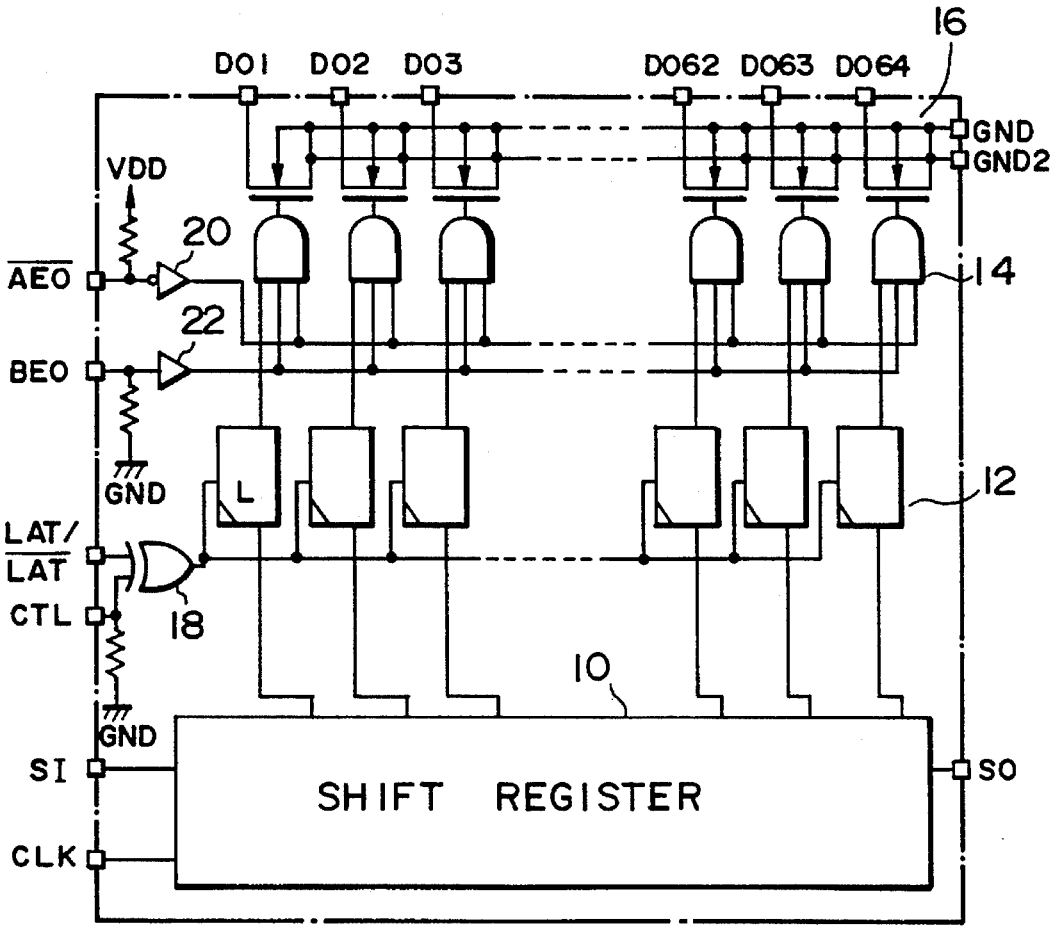
FIG. 11 is a circuit diagram showing the structure of a conventional thermal head driving IC.

FIG. 1 shows the structure of a first embodiment of a thermal head driving IC according to the present invention. As is obvious from FIG. 1, the latches 12 shown in FIG. 11 are not used in this embodiment. The parallel output of the shift register 10 is directly input to AND gates 14'. The AND gates 14' are composed of 64 two-input AND gates unlike the AND gates 14.

In this embodiment, an input selection circuit 24 is provided within the IC in order to obviate the latches 12. The input selection circuit 24 includes AND gates 26, 28, an exclusive OR (hereinunder referred to as "EOR") gate 30 and an inverter 32. The input selection circuit 24 inputs signals from select signal input terminals SEL-1, SEL-2, a strobe signal input terminal $\overline{STB}$ and a clock signal input terminal CLK. The input selection circuit 24 outputs signals to the shift register 10 and each AND gate 14'.

The AND gate 26 obtains the AND of the clock input from the clock signal input terminal CLK and the output of the inverter 32, and outputs the AND to the shift register 10 as a gated clock signal. The inverter 32 obtains the logical NOT of the output of the EOR gate 30 and outputs the result to the AND gate 26. Therefore, the clock input from the clock signal input terminal CLK is supplied to the shift register 10 when the output of the EOR gate 30 has a low level, but it is not supplied when the output has a high level. Consequently, the shift register 10 converts the serial data input from the serial data input terminal SI into parallel data only when the output from the EOR gate 30 has a low level.

The AND gate 28 obtains the AND of the output of the EOR gate 30 and the logical NOT of the strobe signal which is input from the strobe signal input terminal $\overline{STB}$, and supplies the AND as a gated strobe signal to each of the AND gates 14'. Therefore, when the output of the EOR gate 30 has a high level, the output of the AND gate 28 is equal to the logical NOT of the strobe signal which is input from the strobe signal input terminal $\overline{STB}$. On the other hand, when the output of the EOR gate 30 has a low level, the level of the output of the AND gate 28 is constantly low.

Each of the AND gates 14' directly inputs the parallel output of the shift register 10 as well as the output of the AND gate 28. Therefore, when the output of the EOR gate 30 has a high level, the output of each AND gate 14' is equal to the parallel output of the shift register 10 while the level of the strobe signal input from the strobe signal input terminal $\overline{STB}$ is low, and it has a low level while the level of the strobe signal input from the strobe signal input terminal $\overline{STB}$ is high. On other hand, when the output of the EOR gate 30 has a low level, the output of each AND gate 14' constantly has a low level whether the level of the strobe signal input from the strobe signal input terminal $\overline{STB}$ is high or low.

The printing operation in accordance with the first embodiment of the thermal head driving IC will now be explained. When the output of the EOR gate 30 has a low level, the serial data input to the IC through the serial data input terminal SI are converted into parallel data by the shift register 10. At the same time, the level of the output of each AND gate 14' becomes low. In this state, although the serial data are converted into parallel data, no printing operation is carried out.

On the other hand, when the output of the EOR gate 30 has a high level, the serial/parallel conversion of data is not executed. However, the logical NOT of the strobe signal input from the strobe signal input terminal $\overline{STB}$ can be input to each AND gate 14' through the AND gate 28. Printing is therefore possible.

The input terminals of the EOR gate 30 are pulled up by resistors R1 and R2, respectively, within the IC. One of the input terminals of the EOR gate 30 is connected to the select signal input terminal SEL-1 and the other is connected to the select signal input terminal SEL-2. The level of the output of the EOR gate 30 becomes low when the input of the select signal input terminal SEL-1 is equal to the input of the select signal input terminal SEL-2, and it becomes high when these inputs are different from each other. That is, it is possible to switch the cycle for executing the serial/parallel conversion of data by the IC and the cycle for executing printing by the IC over to each other by using the signals which are input from the select signal input terminals SEL-1 and SEL-2. Since such a switching is provided in this embodiment, the shift register 10 and the AND gates 14' operate with different timings.

Thus, the latches which are conventionally used to execute data input and serial/parallel conversion in parallel with printing operation are obviated. As a result, the number of gates is reduced and the scale of the circuit is cut down. It is therefore possible to produce the thermal head driving IC at a low cost. In addition, the high-speed printing capacity is maintained.

The strobe signal only determines the time (quantity of heat) for supplying electric power to the resistors, and whether or not the printing operation is executed by the IC is determined by the level of a select signal other than the strobe signal. It is therefore not necessary to use plural kinds of strobe signal at the time of printing in several blocks separately from each other by using a plurality of the ICs having the same structure as the structure shown in FIG. 1. As a result, the structure of the interface between the plurality of ICs and an external circuit is simplified, and a method of controlling the ICs is also simplified. If either of the select signal input terminals SEL-1 and SEL-2 is pulled down in each block, a small number of select signal suffices in each IC.

Figure 2:
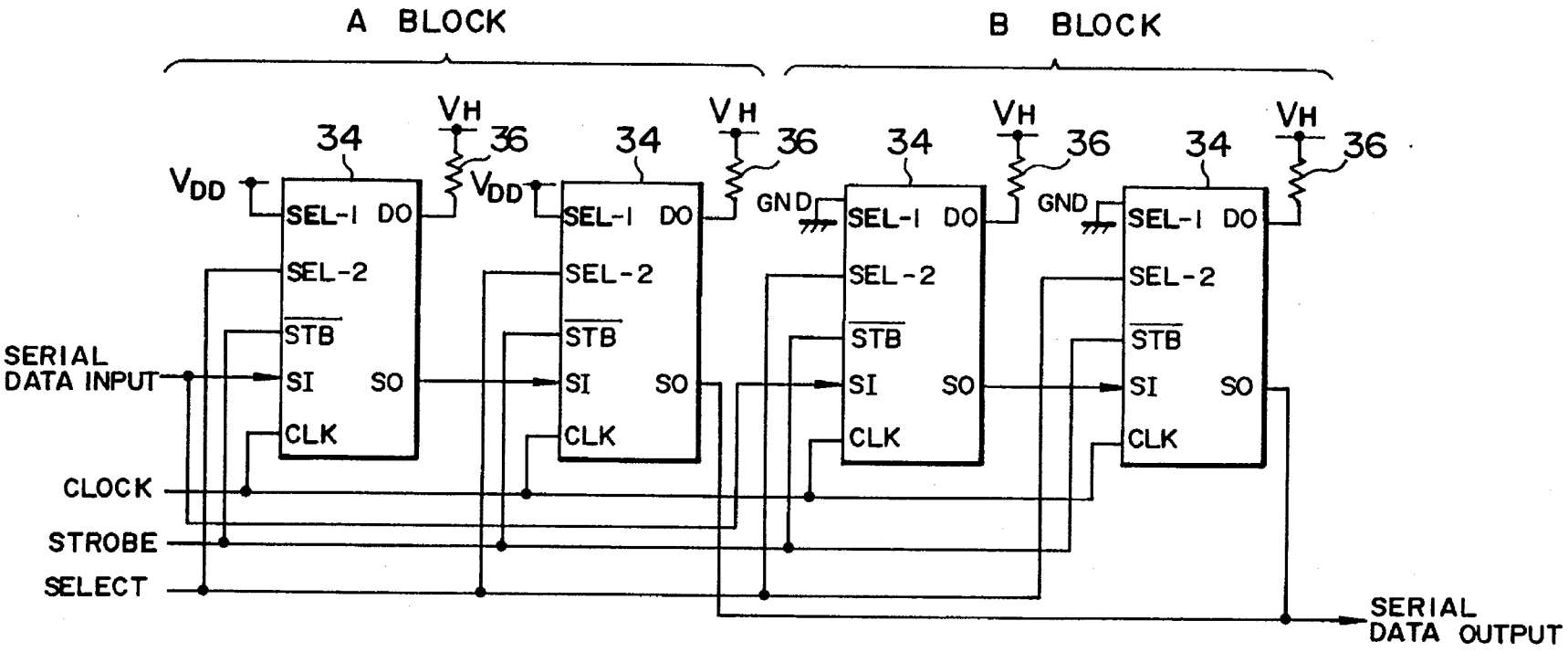
FIG. 2 shows an example of a method of using the first embodiment shown in FIG. 1.

FIG. 2 shows the structure of a thermal head driving circuit using four ICs 34 having the same structure as the first embodiment. Two of the ICs 34 are allotted to a block A and the other two to a block B. According to this circuit, it is possible to print in two blocks separately from each other. In order to simplify the drawing, only one output terminal DO and one resistor 36 which is connected to the output terminal DO are shown, but there are actually 64 output terminals DO and 64 resistors 36 per IC 34.

Two ICs 34 allotted to the same block are cascaded. For example, the serial data output terminal SO of the left-hand IC 34 in FIG. 2 which is allotted to the block A is connected to the serial data input terminal SI of the IC 34 on the right-hand side thereof. Similarly, the serial data output terminal SO of the left-hand IC 34 in FIG. 2 which is allotted to the block B is connected to the serial data input terminal SI of the IC 34 on the right-hand side thereof. Both block A and block B therefore have an output of 128 bits.

The select signal input terminals SEL-1 of the ICs 34 which are allotted to the block A are pulled up by a power source VDD and the select signal input terminals SEL-1 of the ICs 34 which are allotted to the block B are pulled down to ground GND. The same select signal is input to both ICs 34 which are allotted to the blocks A and B from the respective select signal input terminals SEL-2. The serial input data, the clock and the strobe signal are also common signals to both blocks A and B. The serial data output is obtained from the ICs 34 on the right-hand side of the blocks A and B, respectively.

Figure 3:
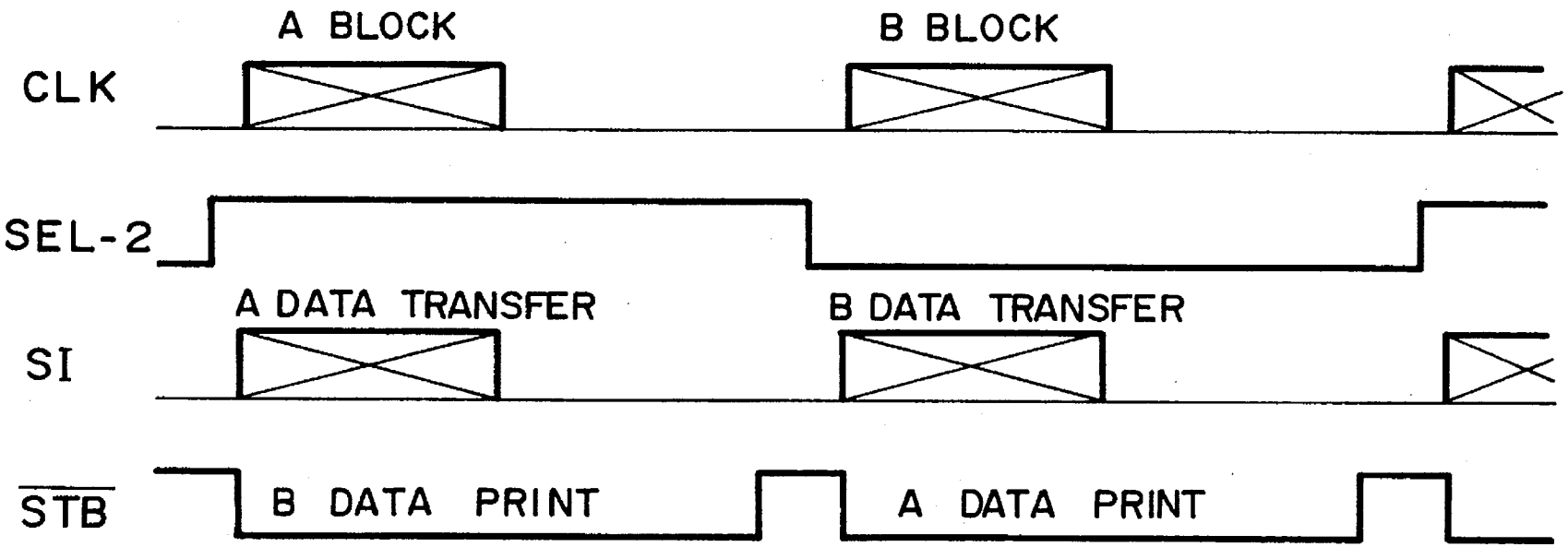
FIG. 3 shows the operational timing of the first embodiment.

FIG. 3 shows a method of driving the circuit shown in FIG. 2 by the timings of the signals which are applied to each terminal (CLK, SEL-2, SI and $\overline{STB}$) of the IC 34. As shown in FIG. 3, the level of the select signal applied to the select signal input terminal SEL-2 changes from a high level to a low level, and vice versa, with a predetermined period. The clock has a much higher frequency than the select signal. The strobe signal is synchronous with the select signal and has a predetermined duty ratio. The duty ratio determines the heating time for the resistor 36.

As shown in FIG. 2, the select signal input terminal SEL-1 of the IC 34 which is allotted to the block A is pulled up, so that one input of the EOR gate 30 is fixed at a low level. Therefore, in this IC 34, while the select signal has a high level, the output of the EOR gate 34 has a low level, and while the select signal has a low level, the output of the EOR gate 34 has a high level. As a result, in the ICs 34 allotted to the block A, the serial/parallel conversion of the input data is executed while the select signal has a high level, and while the select signal has a low level, gate signals are supplied from the AND gates 14' to the transistors 16 (i.e., printing operation is executed).

The select signal input terminal SEL-1 of the IC 34 which is allotted to the block B is pulled down, so that one input of the EOR gate 30 is fixed at a low level. Therefore, in this IC 34, while the select signal has a high level, the output of the EOR gate 34 has a high level, and while the select signal has a low level, the output of the EOR gate 34 has a low level. As a result, in the ICs 34 allotted to the block B gate signals are supplied from the AND gates 14' to the transistors 16 (i.e., printing operation is executed) while the select signal has a high level, and while the select signal has a low level, the serial/ parallel conversion of the input data is executed.

That is, while the select signal has a high level, the serial input data are input to the IC 34 which is allotted to the block A and the data are converted into parallel data (DATA TRANSFER TO BLOCK A). At the same time, printing operation is executed by the IC 34 which is allotted to the block B while the strobe signal is generated. On the other hand, while the select signal has a low level, the serial input data are input to the IC 34 which is allotted to the block B and the data are converted into parallel data (DATA TRANSFER TO BLOCK B). At the same time, printing operation is executed by the IC 34 which is allotted to the block A while the strobe signal is generated.

In this way, in printing in blocks separately from each other by using the ICs 34 of this embodiment, either select signal input terminals SEL-1 or SEL-2 is fixed at a potential different for each block, and the select signal is input to the other select signal input terminal SEL-1 or SEL-2. In spite of the operational logic which is different for each block, high-speed printing is enabled by using the ICs 34 having the same specification and only one kind of strobe signal. Thus, it is not necessary to change the manufacturing steps in producing the IC 34 in correspondence with different operational logic levels.

In FIG. 2, the SEL-1 in the IC 34 allotted to the block A is pulled up by the external power source VDD simply in order to make the method of using the IC clear. Actually, pullup outside of the IC 34 is not necessary. Since pullup is conducted within the IC 34, it is necessary merely to omit wire bonding of the SEL-1 (keep the SEL-1 open). As a result, the number of necessary wire bonding steps is reduced.

Figure 4:
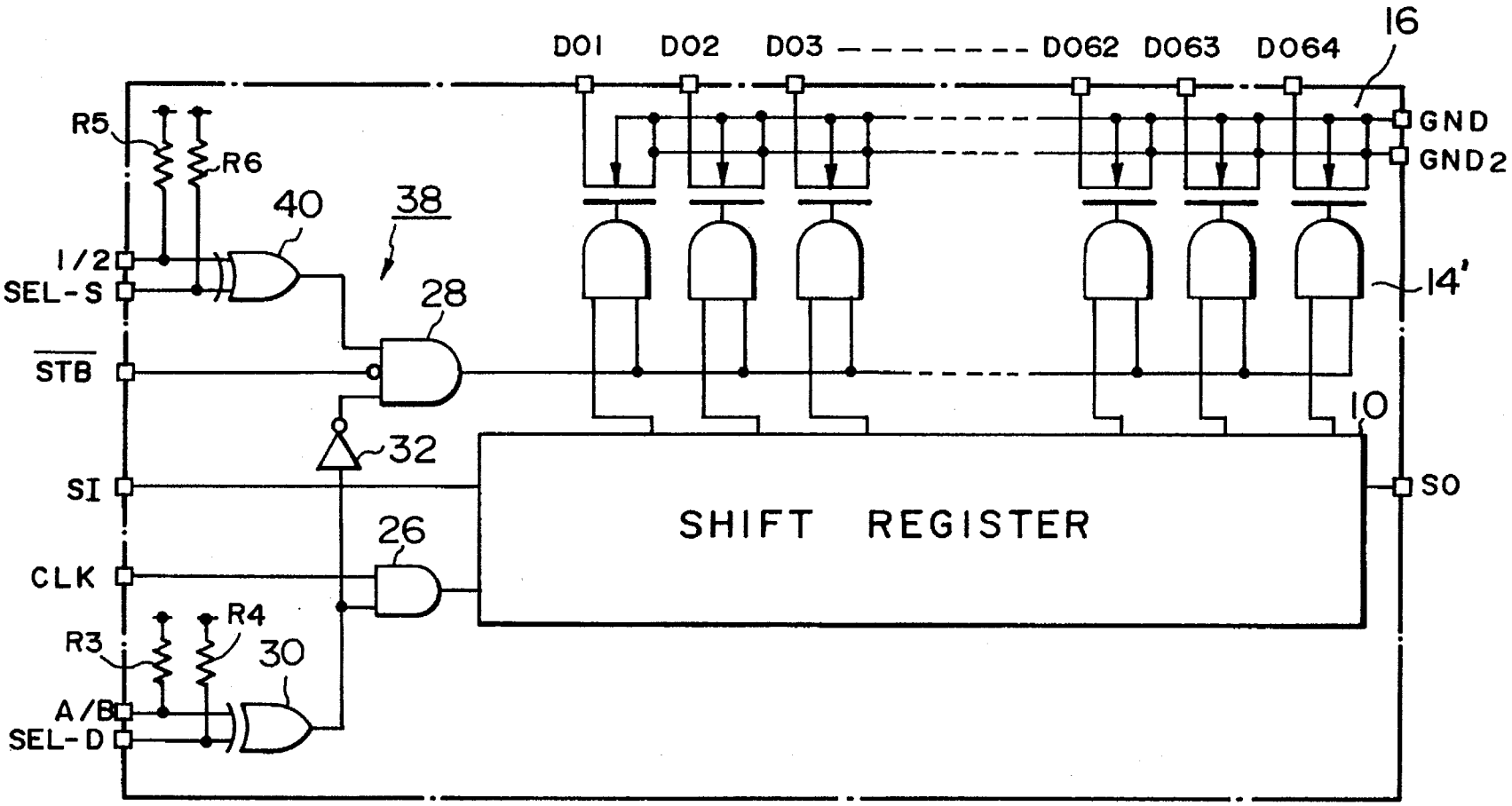
FIG. 4 is a circuit diagram showing the structure of a second embodiment of a thermal head driving IC according to the present invention.

FIG. 4 shows the structure of a second embodiment of a thermal head driving IC according to the present invention. The same numerals are provided for the elements which are the same as those in the first embodiment, and explanation thereof will be omitted.

In this embodiment, four select signal input terminals SEL-D, A/B, SEL-S and 1/2 are provided. An input selection circuit 38 is provided with the AND gates 26, 28, the EOR gate 30 and the inverter 32 in the same way as in the first embodiment. However, the method of using the AND gates 26, 28, the EOR gate 30 and the inverter 32, and the their functions are different from those in the first embodiment. The input selection circuit 38 is further provided with an EOR gate 40.

A clock is input to one of the input terminals of the AND gate 26 through the clock signal input terminal CLK, and the output of the EOR gate 30 is input to the other terminal (not through the inverter 32). Therefore, the clock input from the clock signal input terminal CLK is supplied to the shift register 10 only when the output of the EOR 30 has a high level. Consequently, the shift register 10 converts the serial data input from the serial data input terminal SI into parallel data only when the output of the EOR gate 30 has a high level, and when the output of the EOR gate 30 is a low level, this processing is not executed. The two input terminals of the EOR 30 are connected to the select signal input terminals SEL-D and A/B, respectively and are pulled up within the IC by resistors R3 and R4, respectively.

The AND gate 28 has three input terminals. One input terminal of the AND gate 28 is connected to the strobe signal input terminal $\overline{STB}$, another to the output terminal of the inverter 32, and the other to the output terminal of the EOR gate 40. The input terminal of the AND gate 28 which is connected to the strobe signal input terminal $\overline{STB}$ is an inverted input terminal. The inverter 32 outputs the logical NOT of the output of the EOR gate 30. Therefore, the output of the AND gate 28 is the AND of the logical NOT of the strobe signal which is input from the strobe signal input terminal $\overline{STB}$, the logical NOT of the output of the EOR gate 30 and the output of the EOR gate 40. The two input terminals of the EOR gate 40 are connected to the select signal input terminals SEL-S and 1/2, respectively, and are pulled up within the IC by resistors R5 and R6.

The output terminal of the AND gate 28 is connected to one input terminal of each AND gate 14'. Therefore, only when the output of the EOR gate 30 has a low level and the output of the EOR gate 40 has a high level, is the logical NOT of the strobe signal which is input from the strobe signal input terminal $\overline{STB}$ input to each AND gate 14'. In other words, only when the output of the EOR gate 30 has a low level and the output of the EOR gate 40 has a high level, is the printing operation executed while the potential of the strobe signal input terminal $\overline{STB}$ is low. No printing is operated at any other time.

In this embodiment, when the output of the EOR gate 30 has a low level, the serial/parallel conversion of the input data is executed, but when the output of the EOR gate 30 has a high level, it is not executed. When the output of the EOR gate 30 has a low level, printing is executed under the condition that the output of the EOR gate 40 has a high level, but when the output of the EOR gate 30 has a high level, no printing is executed whether the level of the output of the EOR gate 40 is high or low. As a result, the serial/parallel conversion timing is constantly different from the printing timing. Whether or not printing is executed by the IC also depends upon the output of the EOR gate 40, and the printing time is determined by the strobe signal.

Figure 5:
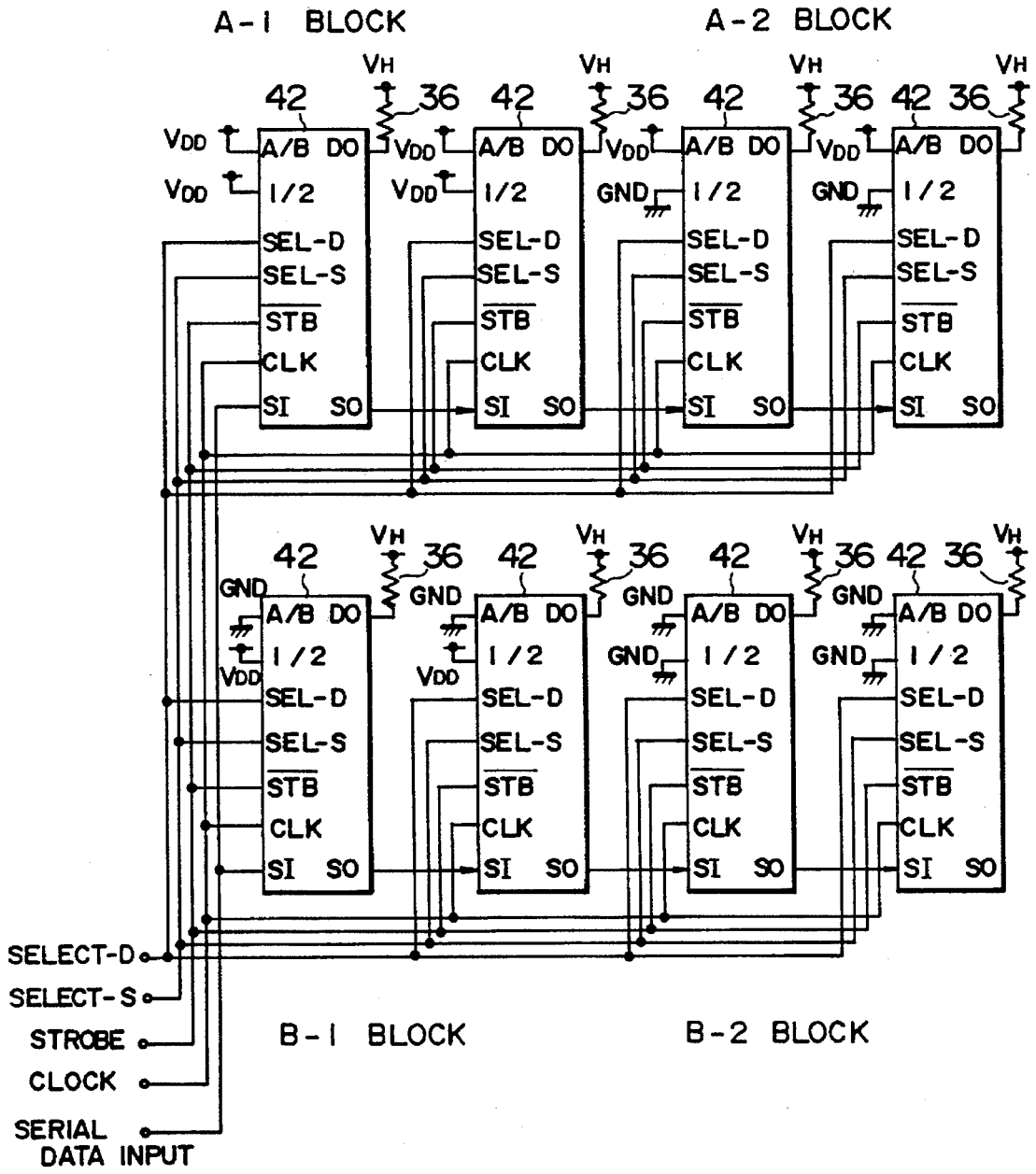
FIG. 5 shows an example of a method of using the second embodiment shown in FIG. 4.

FIG. 5 shows the structure of a thermal head driving circuit using eight ICs 42 having the same structure as the second embodiment. This circuit is used to print in four blocks separately from each other. Two ICs 42 shown at the above left of the drawing are allotted to a block A-1, two ICs 42 shown at the above right of the drawing are allotted to a block A-2, two ICs 42 shown at the below left of the drawing are allotted to a block B-1, and two ICs 42 shown at the below right of the drawing are allotted to a block B-2. In FIG. 5, only one output terminal DO and one resistor 36 are shown in the same way as in FIG. 2.

Two ICs 42 allotted to the same block are cascaded. The serial data input to the IC 42 in the block A-2 are the serial data output from the IC 42 in the block A-1. Similarly, the serial data input to the IC 42 in the block B-2 is the serial data output from the IC 42 of the block B-1. The serial data are input to the block A-1 and to the block B-1 through a common signal line. Therefore, the serial data of 64 bits×4=256 bits are converted into parallel data by the ICs in the block A-1 in cooperation with the ICs in the block A-2, and the serial data of 256 bits are converted into parallel data by the ICs in the block B-1 in cooperation with the ICs in the block B-2.

The select signal input terminals SEL-D of the ICs 42 are connected to each other by a common signal line. Similarly, the select signal input terminals SEL-S of the ICs 42 are connected to each other by a common signal line. The select signal input terminals strobe signal input terminal $\overline{STB}$ of the ICs 42 are also connected to each other by a common signal line. Furthermore, the clock signal input terminals CLK of the ICs 42 are connected to each other by a common signal line.

The select signal input terminals A/B and 1/2 of each IC 42 are pulled up or pulled down outside of the IC 42. In the blocks A-1 and A-2, the select signal input terminal A/B is pulled up, while in the blocks B-1 and B-2, the select signal input terminal A/B is pulled down. In the blocks A-1 and B-1, the select signal input terminal 1/2 is pulled up, while in the blocks A-2 and B-2, the select signal input terminal 1/2 is pulled down. Therefore, in the block A-1, the terminal A/B is fixed at a high potential and the terminal 1/2 at a high potential; in the block A-2, the terminal A/B is fixed at a high potential and the terminal 1/2 at a low potential; in the block B-1, the terminal A/B is fixed at a low potential and the terminal 1/2 at a high potential; and in the block B-2, the terminal A/B is fixed at a low potential and the terminal 1/2 at a low potential.

Figure 6:
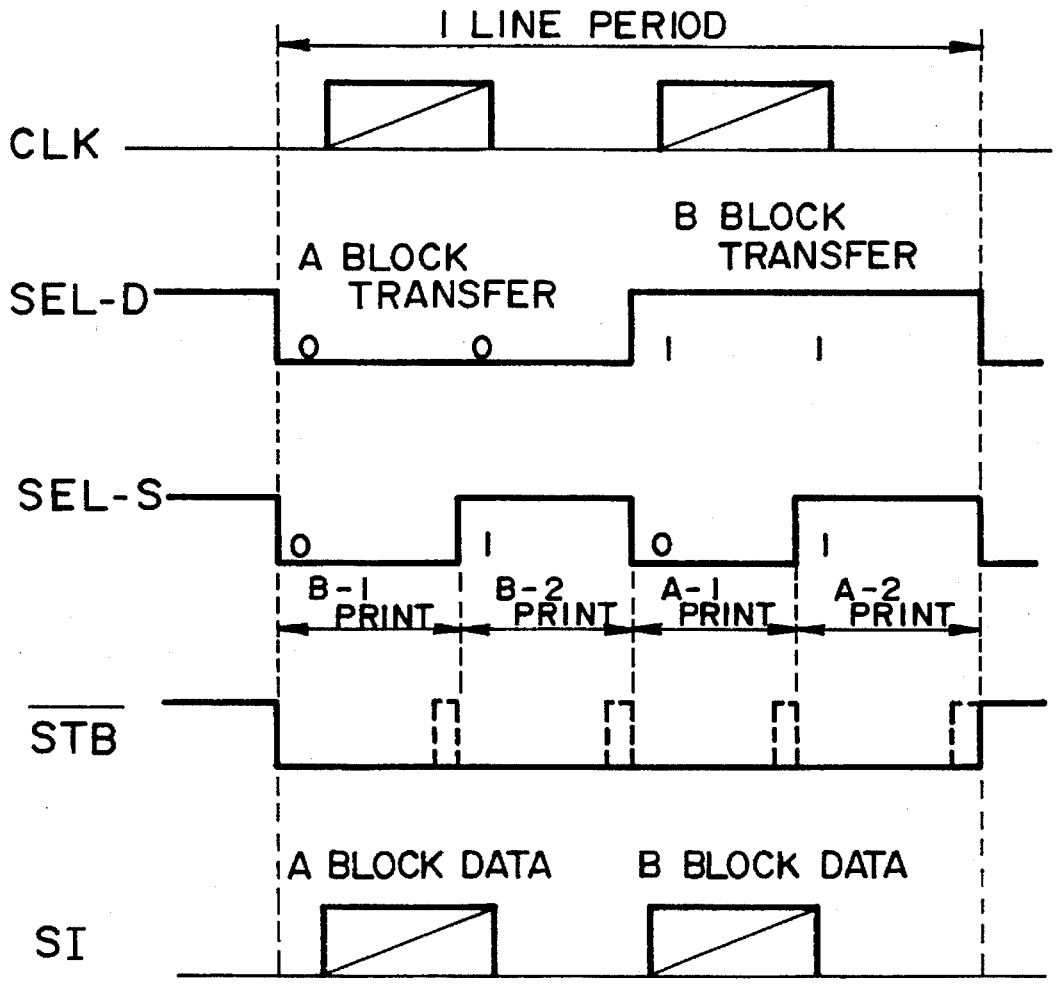
FIG. 6 shows the operational timing of the second embodiment.

FIG. 6 shows a method of driving the circuit shown in FIG. 5 by the timings of the signals which are applied to each terminal of the IC 42.

A select signal which is input from the terminal SEL-D to each IC 42 is a signal whose level changes from a high level ("1") to a low level ("0") with a predetermined period. A select signal which is input from the terminal SEL-S to each IC 42 has double the period of the select signal which is input from the terminal SEL-D. In FIG. 6, a select signal of 2 bits is used, and the select signal which is input from the terminal SEL-D represents a first bit and the select signal which is input from the terminal SEL-S represents a last bit, respectively.

When the first bit of the select signal (i.e., the select signal which is input from the terminal SEL-D) has a low level, the output of the EOR gate 30 is equal to the input of the terminal A/B in any IC 42. Accordingly, in the IC 42 whose terminal A/B is pulled up outside thereof, namely, in the IC 42 which is allotted to the block A-1 or A-2, the level of the output of the EOR gate 30 becomes high while the first bit of the select signal has a low level. In the IC 42 whose terminal A/B is pulled down outside thereof, namely, in the IC 42 which is allotted to the block B-1 or B-2, the level of the output of the EOR gate 30 becomes low while the first bit of the select signal has a low level.

On the other hand, when the first bit of the select signal has a high level, the output of the EOR gate 30 is equal to the logical NOT of the input of the terminal A/B in any IC 42. Accordingly, in the IC 42 which is allotted to the block A-1 or A-2, the level of the output of the EOR gate 30 becomes low while the first bit of the select signal has a high level. In the IC 42 which is allotted to the block B-1 or B-2, the level of the output of the EOR gate 30 becomes high while the first bit of the select signal has a high level.

When the last bit of the select signal (i.e., the select signal which is input from the terminal SEL-S) has a low level, the output of the EOR gate 40 is equal to the input of the terminal 1/2 in any IC 42. Accordingly, in the IC 42 whose terminal 1/2 is pulled up outside thereof, namely, in the IC 42 which is allotted to the block A-1 or B-1, the level of the output of the EOR gate 40 becomes high while the last bit of the select signal has a low level. In the IC 42 whose terminal 1/2 is pulled down outside thereof, namely, in the IC 42 which is allotted to the block A-2 or B-2, the level of the output of the EOR gate 40 becomes low while the last bit of the select signal has a low level.

On the other hand, when the last bit of the select signal has a high level, the output of the EOR gate 40 is equal to the logical NOT of the input of the terminal 1/2 in any IC 42. Accordingly, in the IC 42 which is allotted to the block A-1 or B-1, the level of the output of the EOR gate 40 becomes low while the last bit of the select signal has a high level. In the IC 42 which is allotted to the block A-2 or B-2, the level of the output of the EOR gate 40 becomes high while the last bit of the select signal has a high level.

The above-described relationship between the select signal and the outputs of the EOR gate 30 and the EOR gate 40 are collectively shown in Table 1, wherein a high level is represented by "1" and a low level by "0".

TABLE 1

| Select signal | | Output of EOR gate 30 | | | | Output of EOR gate 40 | | | |
|---|---|---|---|---|---|---|---|---|---|
| SEL-D | SEL-S | A-1 | A-2 | B-1 | B-2 | A-1 | A-2 | B-1 | B-2 |
| 0 | 0 | 1 | 1 | 0 | 0 | 1 | 0 | 1 | 0 |
| 0 | 1 | 1 | 1 | 0 | 0 | 0 | 1 | 0 | 1 |
| 1 | 0 | 0 | 0 | 1 | 1 | 1 | 0 | 1 | 0 |
| 1 | 1 | 0 | 0 | 1 | 1 | 0 | 1 | 0 | 1 |

Since serial/parallel conversion is executed by the shift register 10 only when the output of the EOR gate 30 has a high level, serial/parallel conversion is operated in each of the four blocks with the timing shown in Table 2.

TABLE 2

| Select signal SEL-D | Blocks in which serial/parallel conversion is executed | |
|---|---|---|
| 0 | A-1 | A-2 |
| 1 | B-1 | B-2 |

In this way, when the level of the select signal which is input from the terminal SEL-D is low, serial/parallel conversion is executed in the blocks A-1 and A-2 in which the terminals A/B are pulled up, as represented by "DATA TRANSFER TO BLOCK A" in FIG. 6. When the level of the select signal which is input from the terminal SEL-D is high, serial/parallel conversion is executed in the blocks B-1 and B-2 in which the terminals A/B are pulled down, as represented by "DATA TRANSFER TO B BLOCK" in FIG. 6. In other words, the ICs 42 of a group in which the terminals A/B are pulled up execute serial/parallel conversion with a different timing from the timing of the ICs 42 of a group in which the terminals A/B are pulled down. The serial/parallel conversion timing is determined by the signal output from the terminal SEL-D. That is, the function of the terminal A/B is to designate the blocks in which serial/parallel conversion is executed simultaneously.

Since the control over the heating operation in accordance with a strobe signal is executed only when the output of the EOR gate 30 has a low level and the output of the EOR gate 40 has a high level, the electric power is supplied to the resistors 36 allotted to each of the four blocks with the timing shown in Table 3.

TABLE 3

| Select signal | | Blocks in which resistors |
|---|---|---|
| SEL-D | SEL-S | are heated |
| 0 | 0 | B-1 |
| 0 | 1 | B-2 |
| 1 | 0 | A-1 |
| 1 | 1 | A-2 |

In this way, when the level of the select signal which is input from the terminal SEL-S is low, printing is executed in the blocks A-1 and B-1 in which the terminals 1/2 are pulled up, and when the level of the select signal which is input from the terminal SEL-S is high, printing is executed in the blocks A-2 and B-2 in which the terminals 1/2 are pulled down. In other words, the ICs 42 of a group in which the terminals 1/2 are pulled up execute printing with a different timing from the timing of the ICs 42 of a group in which the terminals 1/2 are pulled down. The printing timing is determined by the signal output from the terminal SEL-S. That is, the function of the terminal 1/2 is, in cooperation with the terminal A/B, to designate the blocks in which printing is executed simultaneously. The printing time is determined in accordance with a strobe signal, as indicated by the broken line in FIG. 6.

Figure 7:
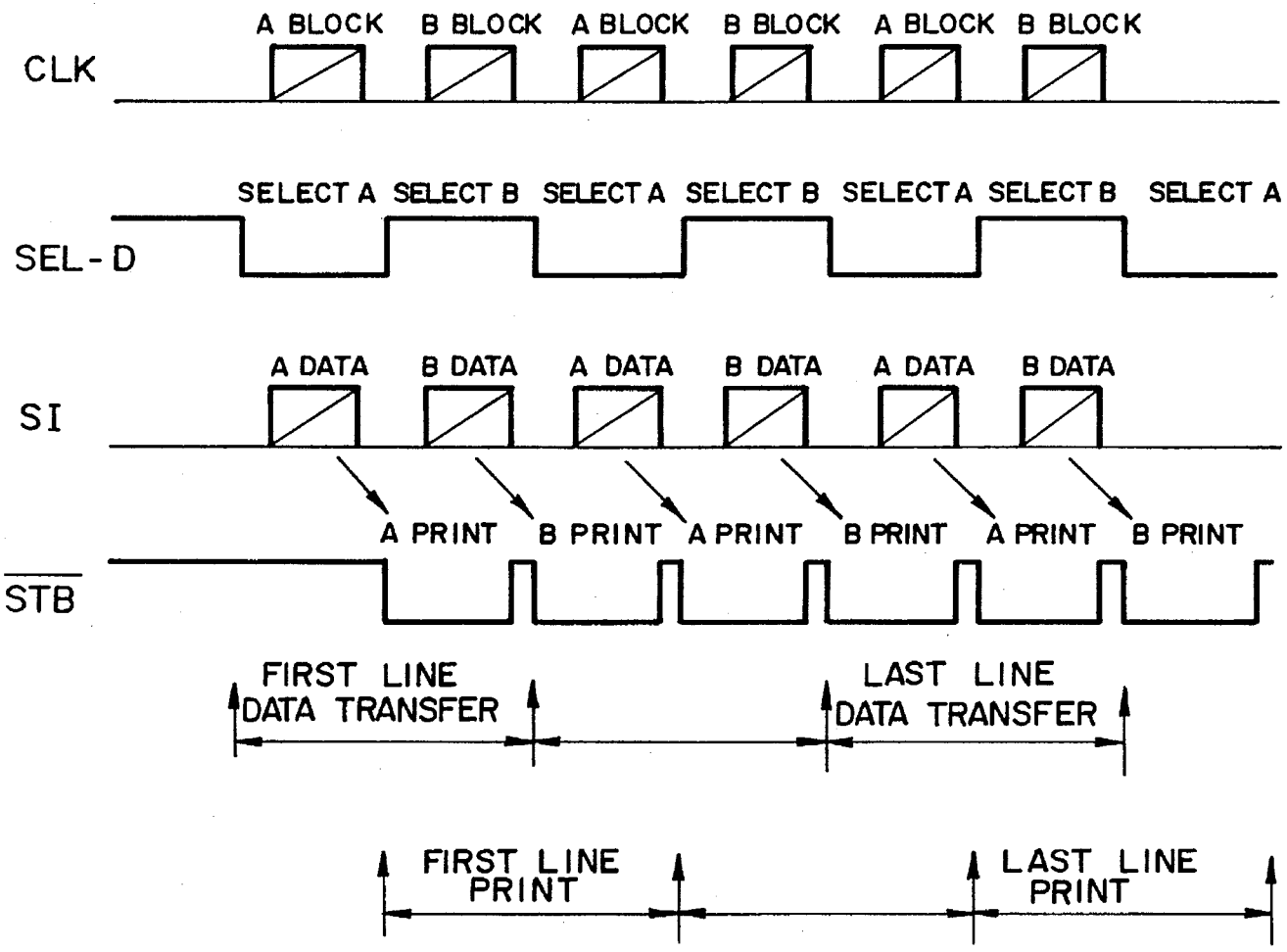
FIG. 7 shows the difference between the data inputting timing and the printing timing in the second embodiment.

FIG. 7 shows the difference between the data inputting timing and the printing timing in this embodiment. As shown in FIG. 7, in this embodiment, the printing timing is delayed by half the period of the select signal input from the terminal SEL-D with respect to the data inputting timing.

This embodiment therefore produces similar advantages to those of the first embodiment. For example, it is possible to print in four blocks separately from each other without the need for latches. It is also possible to print in two blocks separately from each other by using the ICs 42 of this embodiment. Although the terminals are pulled outside of the IC 42 in FIG. 5, since pullup is also conducted within the IC 42, as shown in FIG. 4, it is not necessary to pull up the terminals A/B and 1/2 outside of the IC 42, and the user has only to keep these terminals open.

Figure 8:
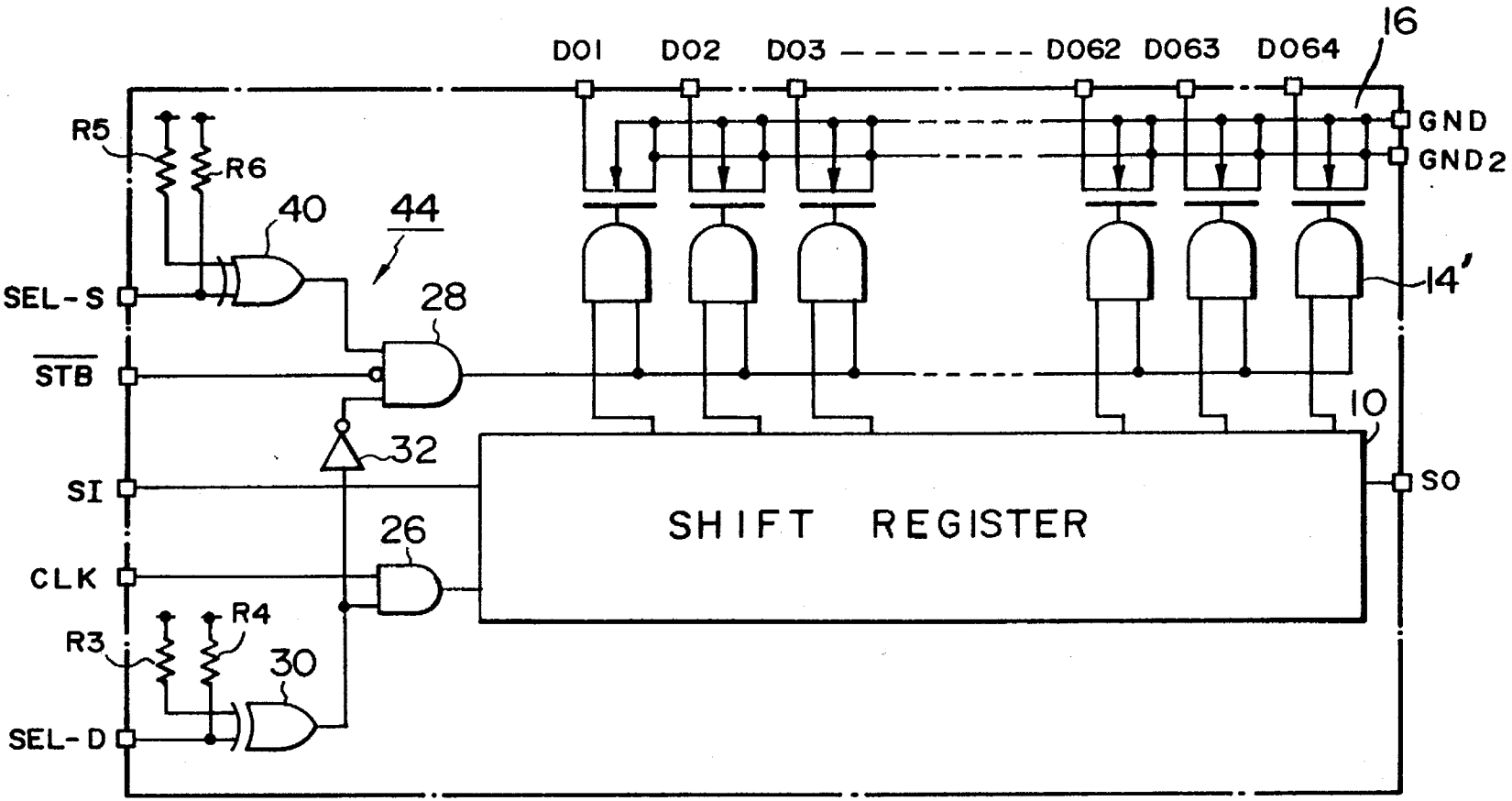
FIG. 8 is a circuit diagram showing the structure of a third embodiment of a thermal head driving IC according to the present invention.

FIG. 8 shows the structure of a third embodiment of a thermal head driving IC according to the present invention. In FIG. 8, the same numerals are provided for the elements which are the same as those in the first and the second embodiments, and explanation thereof will be omitted. In this embodiment, an input selection circuit 44 having approximately the same structure as that of the second embodiment is used. This embodiment is different from the second embodiment in that the terminals A/B and 1/2 are not used. The resistors R3 and R5 pull up one of the input terminals of the EOR gates 30 and 40, respectively. It is therefore possible to reduce the number of terminals, thereby simplifying the wiring pattern and reducing the size of the thermal head.

Figure 9:
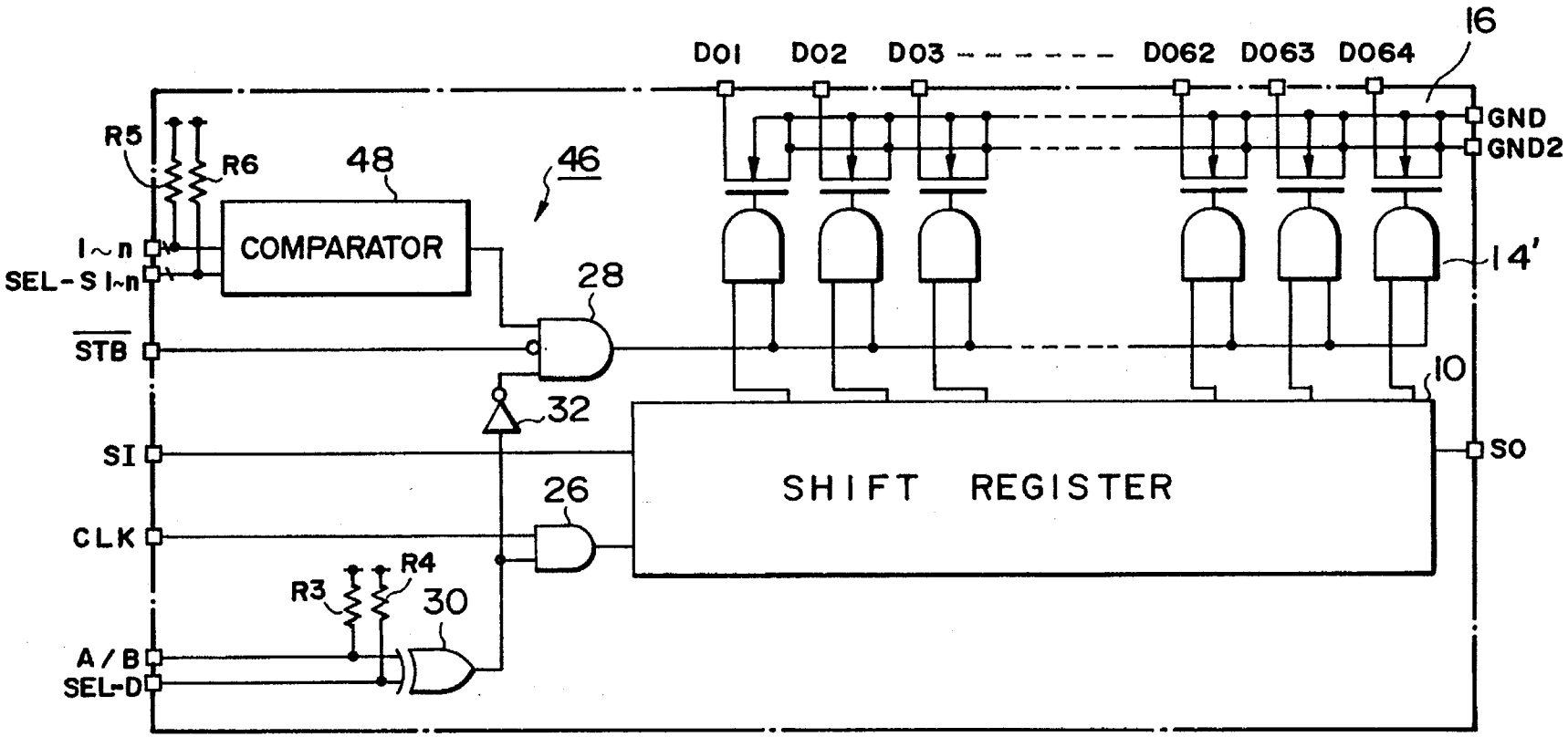
FIG. 9 is a circuit diagram showing the structure of a fourth embodiment of a thermal head driving IC according to the present invention.
Figure 10:
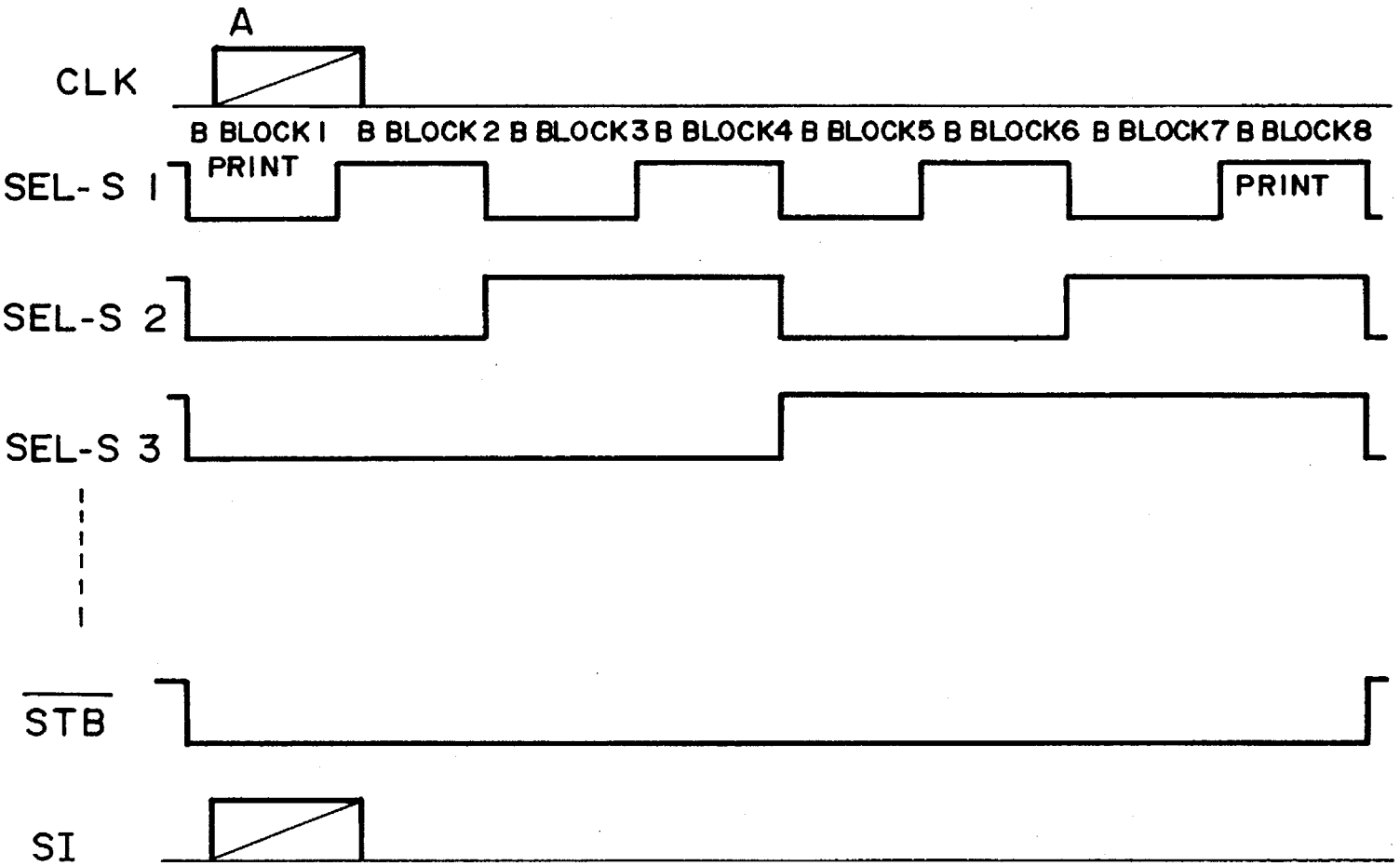
FIG. 10 shows the operational timing of the fourth embodiment.

FIG. 9 shows the structure of a fourth embodiment of a thermal head driving IC according to the present invention. In FIG. 9, the same numerals are provided for the elements which are the same as those in the first to third embodiments, and explanation thereof will be omitted. In this embodiment, the terminals 1/2 and SEL-S in the second embodiment are provided in n pairs, and n resistors R5 and R6 are also provided in correspondence with these terminals. In FIG. 9, however, only one pair of terminals and one pair of resistors are shown so as to simplify the drawing. The input selection circuit 46 uses a comparator 48 in place of the EOR gate 40. The comparator 48 outputs a signal having a high level when the input is a combination of predetermined values. Therefore, by generalizing the operation shown in FIG. 6 as shown in FIG. 10, it is possible to print any given number of blocks separately from each other.

In these embodiments, the IC has 64 bits and each block has an output of 128 bits, but the present invention does not restrict the number of bits. In addition, if the circuit of the present invention is combined with known resistors and the like, a small thermal head which is capable of high-speed printing is obtained. The present invention includes such apparatus and machines.

As described above, according to the thermal head driving IC of the present invention, since a select signal input terminal is provided so as to determine the data inputting timing and the resistor heating timing, only one kind of strobe signal which determines the heating (printing) time suffices, thereby simplifying the external interface. In addition, since the serial data input timing and the resistor heating timing are made different from each other, a means such as a latch circuit is obviated, which leads to a reduction in the size of the circuit.

According to the thermal head driving circuit of the present invention, since several of a plurality of select signal input terminals are fixed at potentials which are different for each of a number of blocks and a select signal is supplied from the remaining terminals, it is possible to use the ICs having the same structure.

According to the thermal head of the present invention, a small-sized and high-speed printing thermal head is realized due to the thermal head driving circuit of the present invention.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A thermal head driving integrated circuit comprising:

a plurality of select signal input terminals for inputting select signals;

a power supplying means for selectively supplying electric power to a plurality of resistors in accordance with supplied parallel data;

a serial/parallel converting means for converting input serial data into parallel data; and an input selecting means for permitting the serial/parallel conversion when the combination of the values input from said select signal input terminals is a first combination, and permitting the selective power supplying operation when said combination of said values input from said select signal input terminals is a second combination.

2. A thermal head driving integrated circuit according to claim 1, wherein said input selecting means includes a means for generating a serial/parallel conversion permitting signal and supplying said signal to said serial/parallel converting means when said combination of said values input from said select signal input terminals is the first combination; and said serial/parallel converting means executes the serial/parallel conversion only when said serial/parallel conversion permitting signal is supplied.

3. A thermal head driving integrated circuit according to claim 1, wherein said input selecting means includes a means for generating a heating operation permitting signal and supplying said signal to said power supplying means when said combination of said values input from said select signal input terminals is the second combination; and said power supplying means executes the selective power supplying operation only when said heating operation permitting signal is supplied.

4. A thermal head driving integrated circuit according to claim 2, wherein said input selecting means includes a means for generating a heating operation permitting signal and supplying said heating operation permitting signal to said power supplying means when said combination of said values input from said select signal input terminals is the second combination; and said power supplying means executes the heating operation only when said heating operation permitting signal is supplied.

5. A thermal head driving integrated circuit according to claim 1, wherein said plurality of select signal input terminals include:

a first select signal input terminal for inputting a first select signal; and a second select signal input terminal for inputting a second select signal;

said input selecting means includes:

a means for generating a heating operation permitting signal by obtaining the exclusive OR of said first select signal and said second select signal; and a means for generating a serial/parallel conversion permitting signal by obtaining the logical NOT of said heating operation permitting signal;

said serial/parallel converting means executes the serial/parallel conversion only when said serial/parallel conversion permitting signal is supplied;

said power supplying means executes the selective power supplying operation only when said heating operation permitting signal is supplied; and said first combination and said second combination are mutually exclusive.

6. A thermal head driving integrated circuit according to claim 1, wherein said plurality of select signal input terminals include:

a first select signal input terminal for inputting a first select signal; and a second select signal input terminal for inputting a second select signal;

said input selecting means includes:

a means for generating a serial/parallel conversion permitting signal by obtaining the exclusive OR of said first select signal and said second select signal; and a means for generating a first heating operation permitting signal by obtaining the logical NOT of said serial/parallel conversion permitting signal;

said serial/parallel converting means executes the serial/parallel conversion only when said serial/parallel conversion permitting signal is supplied; and said power supplying means executes the selective power supplying operation only when at least said first heating operation permitting signal is supplied.

7. A thermal head driving integrated circuit according to claim 6, wherein said plurality of select signal input terminals further include:

a third select signal input terminal for inputting a third select signal; and a fourth select signal input terminal for inputting a fourth select signal;

said input selecting means further includes a means for generating a second heating operation permitting signal by obtaining the exclusive OR of said third select signal and said fourth select signal; and said power supplying means executes the selective power supplying operation only when both said first heating operation permitting signal and said second heating operation permitting signal are supplied.

8. A thermal head driving integrated circuit according to claim 6, wherein said plurality of select signal input terminals further include:

a plurality of third select signal input terminals for inputting a plurality of third select signals; and a plurality of fourth select signal input terminal for inputting a plurality of fourth select signals;

said input selecting means further includes a means for generating a second heating operation permitting signal when the combination of said plurality of third select signals and said plurality of fourth select signals is a predetermined combination; and said power supplying means executes the selective power supplying operation only when both said first heating operation permitting signal and said second heating operation permitting signal are supplied.

9. A thermal head driving integrated circuit according to claim 1, wherein said plurality of select signal input terminals include a first select signal input terminal for inputting a first select signal;

said input selecting means includes:

a means for generating a serial/parallel conversion permitting signal by obtaining the exclusive OR of said first select signal and a first fixed value; and a means for generating a first heating operation permitting signal by obtaining the logical NOT of said serial/parallel conversion permitting signal;

said serial/parallel converting means executes the serial/parallel conversion only when said serial/parallel conversion permitting signal is supplied; and said power supplying means executes the selective power supplying operation only when at least said first heating operation permitting signal is supplied.

10. A thermal head driving integrated circuit according to claim 9, further comprising a pullup resistor for supplying said first fixed value.

11. A thermal head driving integrated circuit according to claim 9, wherein said plurality of select signal input terminals further include a second select signal input terminal for inputting a second select signal;

said input selecting means further includes a means for generating a second heating operation permitting signal by obtaining the exclusive OR of said second select signal and a second fixed value; and said power supplying means executes the selective power supplying operation only when both said first heating operation permitting signal and said second heating operation permitting signal are supplied.

12. A thermal head driving integrated circuit according to claim 11, further comprising a pullup resistor for supplying said second fixed value.

13. A thermal head driving integrated circuit according to claim 1, further comprising:

a serial data input terminal for inputting serial data;

a clock signal input terminal for inputting a clock signal;

a strobe signal input terminal for inputting a strobe signal; wherein said serial/parallel converting means includes a shift register for converting said serial data, which are input from an external device to said integrated circuit through said serial data input terminal, into parallel data by bit-shifting said serial data in accordance with said clock signal, and supplying said parallel data to said power supplying means; and said power supplying means includes:

a plurality of AND gates for obtaining the ANDs of respective bits of said parallel data which are obtained from said shift register and said strobe signal only when the selective power supplying operation is permitted by said input selecting means; and a plurality of driving elements which are provided in correspondence with said plurality of resistors and which are controlled by the AND obtained by said AND gates.

14. A thermal head driving integrated circuit according to claim 13, wherein said driving elements are transistors.

15. A thermal head driving integrated circuit according to claim 13, wherein said plurality of select signal input terminals include:

a first select signal input terminal for inputting a first select signal; and a second select signal input terminal for inputting a second select signal; and said input selecting means includes:

a means for generating a heating operation permitting signal by obtaining the exclusive OR of said first select signal and said second select signal;

a heating operation permitting means for permitting the selective power supplying operation of said power supplying means by gating said strobe signal in accordance with said heating operation permitting signal and supplying the gated strobe signal to said power supplying means;

a means for generating a serial/parallel conversion permitting signal by obtaining the logical NOT of said heating operation permitting signal; and a serial/parallel conversion permitting means for permitting the serial/parallel conversion of said serial/parallel converting means by gating said clock signal in accordance with said serial/parallel conversion permitting signal and supplying the gated clock signal to said serial/parallel converting means.

16. A thermal head driving integrated circuit according to claim 13, wherein said plurality of select signal input terminals include:

a first select signal input terminal for inputting a first select signal; and a second select signal input terminal for inputting a second select signal;

said input selecting means includes:

a means for generating a serial/parallel conversion permitting signal signal by obtaining the exclusive OR of said first select signal and said second select signal;

a serial/parallel conversion permitting means for permitting the serial/parallel conversion of said serial/parallel converting means by gating said clock signal in accordance with said serial/parallel conversion permitting signal and supplying the gated clock signal to said serial/parallel converting means; and a means for generating a first heating operation permitting signal by obtaining logical NOT of said serial/parallel conversion permitting signal;

said serial/parallel converting means executes the serial/parallel conversion conversion only when said serial/parallel conversion permitting signal is supplied; and said power supplying means executes the selective power supplying operation only when at least said first heating operation permitting signal is supplied.

17. A thermal head driving integrated circuit according to claim 16, wherein said plurality of select signal input terminals further include:

a third select signal input terminal for inputting a third select signal; and a fourth select signal input terminal for inputting a fourth select signal;

said input selecting means further includes:

a means for generating a second heating operation permitting signal by obtaining the exclusive OR of said third select signal and said fourth select signal; and a heating operation permitting means for permitting the selective power supplying operation of said power supplying means by gating said strobe signal in accordance with said first heating operation permitting signal and said second heating operation permitting signal and supplying the gated strobe signal to said power supplying means; and said power supplying means executes the selective power supplying operation only when both the first heating operation permitting signal and the second heating operation permitting signal are supplied.

18. A thermal head driving integrated circuit according to claim 13, wherein said plurality of select signal input terminals further include:

a plurality of third select signal input terminals for inputting a plurality of third select signals; and a plurality of fourth select signal input terminals for inputting a plurality of fourth select signals;

said input selecting means further includes:

a means for generating a second heating operation permitting signal when the combination of said plurality of third select signals and said plurality of fourth select signals is a predetermined combination; and a heating operation permitting means for permitting the selective power supplying operation of said power supplying means by gating said strobe signal in accordance with said first heating operation permitting signal and said second heating operation permitting signal and supplying the gated strobe signal to said power supplying means;

said power supplying means executes the selective power supplying operation only when both said first heating operation permitting signal and said second heating operation permitting signal are supplied.

19. A thermal head driving integrated circuit according to claim 13, wherein said plurality of select signal input terminals include a first select signal input terminal for inputting a first select signal;

said input selecting means includes:

a means for generating a serial/parallel conversion permitting signal by obtaining the exclusive OR of said first select signal and a first fixed value;

a serial/parallel conversion permitting means for permitting the serial/parallel conversion of said serial/parallel converting means by gating said clock signal in accordance with said serial/parallel conversion permitting signal and supplying the gated clock signal to said serial/parallel converting means; and a means for generating a first heating operation permitting signal by obtaining the logical NOT of said serial/parallel conversion permitting signal;

said serial/parallel converting means executes the serial parallel conversion only when said serial/parallel conversion permitting signal is supplied; and said power supplying means executes the selective power supplying operation only when at least said first heating operation permitting signal is supplied.

20. A thermal head driving integrated circuit according to claim 19, further comprising a pullup resistor for supplying said first fixed value.

21. A thermal head driving integrated circuit according to claim 19, wherein said plurality of select signal input terminals further include a second select signal input terminal for inputting a second select signal;

said input selecting means further includes:

a means for generating a second heating operation permitting signal by obtaining the exclusive OR of said second select signal and a second fixed value; and a heating operation permitting means for permitting the selective power supplying operation of said power supplying means by gating said strobe signal in accordance with said first heating operation permitting signal and said second heating operation permitting signal and supplying the gated strobe signal to said power supplying means; and said power supplying means executes the selective power supplying operation only when both said first heating operation permitting signal and said second heating operation permitting signal are supplied.

22. A thermal head driving integrated circuit according to claim 21, further comprising a pullup resistor for supplying said second fixed value.

23. A thermal head driving integrated circuit according to claim 13, wherein said power supplying means includes a plurality of output terminals for connecting said driving elements and said resistors.

24. A thermal head driving integrated circuit according to claim 13, further comprising a serial output terminal for outputting externally from said integrated circuit the serial data which overflow said shift register as a result of bit shifting by said shift register.

25. A thermal head driving integrated circuit according to claim 1, wherein said input selecting means further includes a means for fixing the potential of at least one of said select signal input terminals.

26. A thermal head driving circuit having a plurality of thermal head driving integrated circuits, each of said thermal head driving integrated circuits comprising:

a plurality of select signal input terminals for inputting select signals;

a power supplying means for selectively supplying electric power to a plurality of resistors in accordance with supplied parallel data;

a serial/parallel converting means for converting input serial data into parallel data; and an input selecting means for permitting the serial/parallel conversion of said serial/parallel converting means when the combination of the values input from said select signal input terminals is a first combination, and permitting the selective power supplying operation of said power supplying means when said combination of the values input from said select signal input terminals is a second combination;

wherein at least one of said thermal head driving integrated circuits is allotted to each of a plurality of blocks each of which is composed of a plurality of resistors, and each of said thermal head driving integrated circuits controls the selective power supplying operation of at least some of said resistors in the corresponding block;

said select signal input terminals of each thermal head driving integrated circuit are divided into at least two groups;

the select signal input terminals of a first group are fixed at a different potential for each block; and a second group including only the select signal input terminals which do not belong to said first group inputs a select signal.

27. A thermal head driving circuit according to claim 26, wherein said input selecting means in each integrated circuit includes a means for generating said serial/parallel conversion permitting signal and supplying said serial/parallel conversion permitting signal to said serial/parallel converting means in the integrated circuit when the combination of the values input from said select signal input terminals of the integrated circuit is a first combination; and said serial/parallel converting means executes the serial/parallel conversion only when said serial/parallel conversion permitting signal is supplied from said input selecting means in the integrated circuit.

28. A thermal head driving circuit according to claim 26, wherein said input selecting means in each integrated circuit includes a means for generating said heating operation permitting signal and supplying said heating operation permitting signal to said power supplying means in the integrated circuit when the combination of the values input from said select signal input terminals of the integrated circuit is a second combination; and said power supplying means executes the selective power supplying operation when said heating operation permitting signal is supplied from said input selecting means in the integrated circuit.

29. A thermal head driving circuit according to claim 27, wherein said input selecting means in each integrated circuit includes a means for generating said heating operation permitting signal and supplying said heating operation permitting signal to said power supplying means in the integrated circuit when the combination of the values input from said select signal input terminals of the integrated circuit is a second combination; and said power supplying means executes the selective power supplying operation when said heating operation permitting signal is supplied from said input selecting means in the integrated circuit.

30. A thermal head driving circuit according to claim 26, wherein each of said integrated circuits further comprises:

a serial data input terminal for inputting serial data;

a clock signal input terminal for inputting a clock signal;

a strobe signal input terminal for inputting a strobe signal to said power supplying means;

a serial data output terminal for outputting serial data externally from said integrated circuit; and a plurality of output terminals through which said power supplying means selectively supplies electric power to said resistors;

said serial/parallel converting means in each integrated circuit converts said serial data, which are input from said serial data input terminal of the integrated circuit, into parallel data and outputs overflowing serial data externally from said serial data output terminal of the integrated circuit, the serial/parallel conversion being executed only when said serial/parallel conversion is permitted by said input selecting means in the integrated circuit; and said power supplying means in each integrated circuit supplies electric power to said resistors which are designated by said parallel data supplied from said serial/parallel converting means in the integrated circuit, through the output terminal of the integrated circuit during the period which is designated by said strobe signal input from said strobe signal input terminal of the integrated circuit, the selective power supplying operation being executed only when said selective power supplying operation is permitted by said input selecting means in the integrated circuit.

31. A thermal head driving circuit according to claim 30, wherein said plurality of select signal input terminals of each integrated circuit include:

a first select signal input terminal for inputting a first select signal; and a second select signal input terminal for inputting a second select signal;

said input selecting means in each integrated circuit includes:

a means for generating a heating operation permitting signal by obtaining the exclusive OR of said first select signal and said second select signal;

a heating operation permitting means for permitting the selective power supplying operation of said power supplying means by gating said strobe signal in accordance with said heating operation permitting signal supplied from said heating operation permitting signal generating means in the integrated circuit and supplying the gated strobe signal to said power supplying means in the integrated circuit;

a means for generating a serial/parallel conversion permitting signal by obtaining the logical NOT of said heating operation permitting signal supplied from said heating operation permitting signal generating means in the integrated circuit; and a serial/parallel conversion permitting means for permitting the serial/parallel conversion of said serial/parallel converting means by gating said clock signal in accordance with said serial/parallel conversion permitting signal supplied from the serial/parallel conversion permitting signal generating means in the integrated circuit and supplying the gated clock signal to said serial/parallel converting means in the integrated circuit.

32. A thermal head driving circuit according to claim 31, wherein the potential of said first select signal input terminal of each integrated circuit is fixed at a different potential for each block;

said second select signal input terminal of each integrated circuit, said clock signal input terminal of each integrated circuit and said strobe signal input terminal of each integrated circuit are respectively connected in common;

the integrated circuits allotted to the same block are cascaded by connecting the serial data output terminal of a preceding integrated circuit to the serial data input terminal of the subsequent integrated circuit; and the cascaded integrated circuits which are allotted to different blocks are connected in parallel by connecting the serial data input terminals of the foremost integrated circuits of the respective cascades.

33. A thermal head driving circuit according to claim 32, wherein said first select signal input terminal of said integrated circuit which is allotted to one of said blocks is pulled up to the supply potential.

34. A thermal head driving circuit according to claim 32, wherein said first select signal input terminal of said integrated circuit which is allotted to one of said blocks is pulled down to the ground potential.

35. A thermal head driving circuit according to claim 30, wherein said plurality of select signal input terminals of each integrated circuit include:

a first select signal input terminal for inputting a first select signal;

a second select signal input terminal for inputting a second select signal;

a third select signal input terminal for inputting a third select signal; and a fourth select signal input terminal for inputting a fourth select signal;

said input selecting means in each integrated circuit includes:

a means for generating a serial/parallel conversion permitting signal by obtaining the exclusive OR of said first select signal and said second select signal;

a serial/parallel conversion permitting means for permitting the serial/parallel conversion of said serial/parallel converting means by gating said clock signal in accordance with said serial/parallel conversion permitting signal supplied from the serial/parallel converting means in the integrated circuit and supplying the gated clock signal to said serial/parallel converting means in the integrated circuit;

a means for generating a first heating operation permitting signal by obtaining the logical NOT of said serial/parallel conversion permitting signal supplied from said serial/parallel converting means in the integrated circuit;

a means for generating a second heating operation permitting signal by obtaining the exclusive OR of said third select signal and said fourth select signal; and a heating operation permitting means for permitting the selective power supplying operation of said power supplying means by gating said strobe signal in accordance with said first heating operation permitting signal and said second heating operation permitting signal and supplying the gated strobe signal to said power supplying means in the integrated circuit;

said serial/parallel converting means executes the serial/parallel conversion only when said serial/parallel conversion is permitted by said serial/parallel conversion permitting means in the integrated circuit; and said power supplying means executes the selective power supplying operation only when said selective power supplying operation is permitted by said heating operation permitting means in the integrated circuit.

36. A thermal head driving circuit according to claim 35, wherein the potentials of said first selection signal input terminal and said third select signal input terminal of each integrated circuit are fixed at different potentials for each block;

said second select signal input terminal of each integrated circuit, said fourth select signal input terminal of each integrated circuit, said clock signal input terminal of each integrated circuit and said strobe signal input terminal of each integrated circuit are respectively connected in common;

the integrated circuits allotted to the same block are cascaded by connecting said serial data output terminal of a preceding integrated circuit to said serial data input terminal of the subsequent integrated circuit;

the cascaded integrated circuits which are allotted to different blocks and which have said first select signal input terminals fixed at an equal potential are cascaded by connecting the serial data output terminal of the integrated circuit at the rearmost stage of the precedent cascade to the serial data input terminal of the integrated circuit at the foremost stage of the subsequent cascade; and the cascaded integrated circuits which are allotted to different blocks and which have said first select signal input terminals fixed at different potentials are connected in parallel by connecting the serial data input terminals of the foremost integrated circuits of the respective cascades.

37. A thermal head driving circuit according to claim 36, wherein said first select signal input terminal of the integrated circuit which is allotted to one of said blocks is pulled up to the supply potential.

38. A thermal head driving circuit according to claim 36, wherein said first select signal input terminal of said integrated circuit which is allotted to one of said blocks is pulled down to the ground potential.

39. A thermal head driving circuit according to claim 30, wherein said plurality of select signal input terminals of each integrated circuit include:

a first select signal input terminal for inputting a first select signal;

a second select signal input terminal for inputting a second select signal;

a plurality of third select signal input terminals for inputting a plurality of third select signals; and a plurality of fourth select signal input terminals for inputting a plurality of fourth select signals;

said input selecting means in each integrated circuit includes:

a means for generating a serial/parallel conversion permitting signal by obtaining the exclusive OR of said first select signal and said second select signal;

a serial/parallel conversion permitting means for permitting the serial/parallel conversion of said serial/parallel converting means by gating said clock signal in accordance with said serial/parallel conversion permitting signal supplied from said serial/parallel converting means in the integrated circuit and supplying the gated clock signal to said serial/parallel converting means in the integrated circuit;

a means for generating a first heating operation permitting signal by obtaining the logical NOT of said serial/parallel conversion permitting signal supplied from said serial/parallel converting means in the integrated circuit;

a means for generating a second heating operation permitting signal when the combination of said plurality of third select signals and said plurality of fourth select signals is a predetermined combination; and a heating operation permitting means for permitting the selective power supplying operation of said power supplying means by gating said strobe signal in accordance with said first heating operation permitting signal and said second heating operation permitting signal and supplying the gated strobe signal to said power supplying means in the integrated circuit;

said serial/parallel converting means in each integrated circuit executes the serial/parallel conversion only when serial/parallel conversion is permitted by said serial/parallel conversion permitting means in the integrated circuit; and said power supplying means executes the selective power supplying operation only when the selective power supplying operation is permitted by said heating operation permitting means in the integrated circuit.

40. A thermal head driving circuit according to claim 30, wherein said plurality of select signal input terminals of each integrated circuit include:

a first select signal input terminal for inputting a first select signal; and a second select signal input terminal for inputting a second select signal;

said input selecting means in each integrated circuit includes:

a means for generating a serial/parallel conversion permitting signal by obtaining the exclusive OR of said first select signal and a first fixed value;

a serial/parallel conversion permitting means for permitting the serial/parallel conversion of said serial/parallel converting means by gating said clock signal in accordance with said serial/parallel conversion permitting signal supplied from said serial/parallel converting means in the integrated circuit and supplying the gated clock signal to said serial/parallel converting means in the integrated circuit;

a means for generating a first heating operation permitting signal by obtaining the logical NOT of said serial/parallel conversion permitting signal supplied from said serial/parallel converting means in the integrated circuit;

a means for generating a second heating operation permitting signal by obtaining the exclusive OR of said second select signal and a second fixed value; and a heating operation permitting means for permitting the selective power supplying operation of said power supplying means by gating said strobe signal in accordance with said first heating operation permitting signal and said second heating operation permitting signal supplied from said first heating operation permitting signal generating means and said second heating operation permitting signal generating means in the integrated circuit and supplying the gated strobe signal to said power supplying means in the integrated circuit;

said serial/parallel converting means executes the serial/parallel conversion only when said serial/parallel conversion is permitted by said serial/parallel conversion permitting means in the integrated circuit; and said power supplying means executes the selective power supplying operation only when selective power supplying operation is permitted by said heating operation permitting means in the integrated circuit.

41. A thermal head driving circuit according to claim 40, wherein each of said integrated circuits further comprises a pullup resistor for supplying said first fixed value.

42. A thermal head driving circuit according to claim 40, wherein each of said integrated circuits further comprises a pullup resistor for supplying said second fixed value.

43. A thermal head driving circuit according to claim 26, wherein said input selecting means in each integrated circuit includes a means for fixing the potential of at least one of said select signal input terminals within the integrated circuit.

44. A thermal head comprising:

a plurality of resistors; and a plurality of thermal head driving integrated circuits; wherein each of said integrated circuit includes:

a plurality of select signal input terminals for inputting select signals;

a power supplying means for selectively supplying electric power to a plurality of resistors in accordance with supplied parallel data;

a serial/parallel converting means for converting input serial data into parallel data; and an input selecting means for permitting the serial/parallel conversion of said serial/parallel converting means when the combination of the values input from said select signal input terminals is a first combination, and permitting the selective power supplying operation of said power supplying means when the combination of the values input from said select signal input terminals is a second combination;

at least one thermal head driving integrated circuit is allotted to each of a plurality of blocks each of which is composed of a plurality of resistors, and each thermal head driving integrated circuit controls the selective power supplying operation of at least a part of said resistors in the corresponding block;

said select signal input terminals of each thermal head driving integrated circuit are divided into at least two groups;

the select signal input terminals of a first group are fixed at a different potential in each block; and a second group including only the select signal input terminals which do not belong to said first group inputs a select signal.

45. A thermal head according to claim 44, wherein said input selecting means in each integrated circuit includes a means for generating a serial/parallel conversion permitting signal and supplying said serial/parallel conversion permitting signal to said serial/parallel converting means in the integrated circuit when the combination of the values input from said select signal input terminals of the integrated circuit is a first combination; and said serial/parallel converting means in the integrated circuit executes the serial/parallel conversion only when said serial/parallel conversion permitting signal is supplied from said input selecting means in the integrated circuit.

46. A thermal head according to claim 44, wherein said input selecting means in each integrated circuit includes a means for generating a heating operation permitting signal and supplying said heating operation permitting signal to said power supplying means in the integrated circuit when the combination of the values input from said select signal input terminals of the integrated circuit is a second combination; and said power supplying means in the integrated circuit executes the selective power supplying operation when said heating operation permitting signal is supplied from said input selecting means in the integrated circuit.

47. A thermal head according to claim 45, wherein said input selecting means in each integrated circuit includes a means for generating a heating operation permitting signal and supplying said heating operation permitting signal to said power supplying means in the integrated circuit when the combination of the values input from said select signal input terminals of the integrated circuit is a second combination; and said power supplying means in the integrated circuit executes the selective power supplying operation when said heating operation permitting signal is supplied from said input selecting means in the integrated circuit.

48. A thermal head according to claim 44, wherein each integrated circuit further comprises:

a serial data input terminal for inputting serial data;

a clock signal input terminal for inputting a clock signal;

a strobe signal input terminal for inputting a strobe signal to said power supplying means;

a serial data output terminal for outputting serial data externally from said integrated circuit; and a plurality of output terminals through which said power supplying means supplies electric power to said resistors;

said serial/parallel converting means converts said serial data, which are input from said serial data input terminal of the integrated circuit, into parallel data and outputs overflowing serial data externally from said serial output terminal of the integrated circuit, the serial/parallel conversion being executed only when said serial/parallel conversion is permitted by said input selecting means of the integrated circuit; and said power supplying means supplies electric power to said resistors which are designated by said parallel data supplied from said serial/parallel converting means of the integrated circuit, through the output terminal of the integrated circuit during the period which is designated by said strobe signal input from said strobe signal input terminal of the integrated circuit, the selective power supplying operation being executed only when said selective power supplying operation is permitted by said input selecting means of the integrated circuit.

49. A thermal head according to claim 48, wherein said plurality of select signal input terminals of each integrated circuit include:

a first select signal input terminal for inputting a first select signal; and a second select signal input terminal for inputting a second select signal;

said input selecting means in each integrated circuit includes:

a means for generating a heating operation permitting signal by obtaining the exclusive OR of said first select signal and said second select signal;

a heating operation permitting means for permitting the selective power supplying operation of said power supplying means in the integrated circuit by gating said strobe signal in accordance with said heating operation permitting signal supplied from said heating operation permitting signal generating means in the integrated circuit and supplying the gated strobe signal to said power supplying means in the integrated circuit;

a means for generating a serial/parallel conversion permitting signal by obtaining the logical NOT of said heating operation permitting signal supplied from said heating operation permitting signal generating means in the integrated circuit; and a serial/parallel conversion permitting means for permitting the serial/parallel conversion of said serial/parallel converting means in the integrated circuit by gating said clock signal in accordance with said serial/parallel conversion permitting signal supplied from the serial/parallel conversion permitting signal generating means in the integrated circuit and supplying the gated clock signal to said serial/parallel converting means in the integrated circuit.

50. A thermal head according to claim 49, wherein the potential of said first selection signal input terminal of each integrated circuit is fixed at a different potential in each block;

said second select signal input terminal of each integrated circuit, said clock signal input terminal of each integrated circuit and said strobe signal input terminal of each integrated circuit are respectively connected in common;

the integrated circuits allotted to the same block are cascaded by connecting the serial data output terminal of a preceding integrated circuit to the serial data input terminal of the subsequent integrated circuit; and the cascaded integrated circuits which are allotted to different blocks are connected in parallel by connecting the serial data input terminals of the foremost integrated circuits of the respective cascades.

51. A thermal head according to claim 50, wherein said first select signal input terminal of said integrated circuit which is allotted to one of said blocks is pulled up to the supply potential.

52. A thermal head according to claim 50, wherein said first select signal input terminal of said integrated circuit which is allotted to one of said blocks is pulled down to the ground potential.

53. A thermal head according to claim 48, wherein said plurality of select signal input terminals of each integrated circuit include:

a first select signal input terminal for inputting a first select signal;

a second select signal input terminal for inputting a second select signal;

a third select signal input terminal for inputting a third select signal; and a fourth select signal input terminal for inputting a fourth select signal; said input selecting means in each integrated circuit includes:

a means for generating a serial/parallel conversion permitting signal by obtaining the exclusive OR of said first select signal and said second select signal;

a serial/parallel conversion permitting means for permitting the serial/parallel conversion of said serial/parallel converting means in the integrated circuit by gating said clock signal in accordance with said serial/parallel conversion permitting signal supplied from the serial/parallel converting means in the integrated circuit and supplying the gated clock signal to said serial/parallel converting means in the integrated circuit;

a means for generating a first heating operation permitting signal by obtaining the logical NOT of said serial/parallel conversion permitting signal supplied from said serial/parallel converting means in the integrated circuit;

a means for generating a second heating operation permitting signal by obtaining the exclusive OR of said third select signal and said fourth select signal; and a heating operation permitting means for permitting the selective power supplying operation of said power supplying means in the integrated circuit by gating said strobe signal in accordance with said first heating operation permitting signal and said second heating operation permitting signal and supplying the gated strobe signal to said power supplying means in the integrated circuit;

said serial/parallel converting means in each integrated circuit executes the serial/parallel conversion only when said serial/parallel conversion is permitted by said serial/parallel conversion permitting means in the integrated circuit; and said power supplying means in each integrated circuit executes the selective power supplying operation only when said selective power supplying operation is permitted by said heating operation permitting means in the integrated circuit.

54. A thermal head according to claim 53, wherein the potentials of said first selection signal input terminal and said third select signal input terminal of each integrated circuit are fixed at different potentials in each block;

said second select signal input terminal of each integrated circuit, said fourth select signal input terminal of each integrated circuit, said clock signal input terminal of each integrated circuit and said strobe signal input terminal of each integrated circuit are respectively connected in common;

the integrated circuits allotted to the same block are cascaded by connecting said serial data output terminal of a preceding integrated circuit to said serial data input terminal of the subsequent integrated circuit;

the cascaded integrated circuits which are allotted to different blocks and which have said first select signal input terminals fixed at an equal potential are cascaded by connecting the serial data output terminal of the integrated circuit at the rearmost stage of the precedent cascade to the serial data input terminal of the integrated circuit at the foremost stage of the subsequent cascade; and the cascaded integrated circuits which are allotted to different blocks and which have said first select signal input terminals fixed at different potentials are connected in parallel by connecting the serial data input terminals of the foremost integrated circuits of the respective cascades.

55. A thermal head according to claim 54, wherein said first select signal input terminal of the integrated circuit which is allotted to one of said blocks is pulled up to the supply potential.

56. A thermal head according to claim 54, wherein said first select signal input terminal of said integrated circuit which is allotted to one of said blocks is pulled down to the ground potential.

57. A thermal head according to claim 48, wherein said plurality of select signal input terminals of each integrated circuit include:

a first select signal input terminal for inputting a first select signal;

a second select signal input terminal for inputting a second select signal;

a plurality of third select signal input terminals for inputting a plurality of third select signals; and a plurality of fourth select signal input terminals for inputting a plurality of fourth select signals;

said input selecting means in each integrated circuit includes:

a means for generating a serial/parallel conversion permitting signal by obtaining the exclusive OR of said first select signal and said second select signal;

a serial/parallel conversion permitting means for permitting the serial/parallel conversion of said serial/parallel converting means in the integrated circuit by gating said clock signal in accordance with said serial/parallel conversion permitting signal supplied from said serial/parallel converting means in the integrated circuit and supplying the gated clock signal to said serial/parallel converting means in the integrated circuit;

a means for generating a first heating operation permitting signal by obtaining the logical NOT of said serial/parallel conversion permitting signal supplied from said serial/parallel converting means in the integrated circuit;

a means for generating a second heating operation permitting signal when the combination of said plurality of third select signals and said plurality of fourth select signals is a predetermined combination; and a heating operation means for permitting the selective power supplying operation of said power supplying means in the integrated circuit by gating said strobe signal in accordance with said first heating operation permitting signal and said second heating operation permitting signal and supplying the gated strobe signal to said power supplying means in the integrated circuit;

said serial/parallel converting means in each integrated circuit executes the serial/parallel conversion only when serial/parallel conversion is permitted by said serial/parallel conversion permitting means in the integrated circuit; and said power supplying means in the integrated circuit executes the selective power supplying operation only when the selective power supplying operation is permitted by said heating operation permitting means in the integrated circuit.

58. A thermal head according to claim 48, wherein said plurality of select signal input terminals of each integrated circuit include:

a first select signal input terminal for inputting a first select signal; and a second select signal input terminal for inputting a second select signal;

said input selecting means in each integrated circuit includes:

a means for generating a serial/parallel conversion permitting signal by obtaining the exclusive OR of said first select signal and a first fixed value;

a serial/parallel conversion permitting means for permitting the serial/parallel conversion of said serial/parallel converting means in the integrated circuit by gating said clock signal in accordance with said serial/parallel conversion permitting signal supplied from said serial/parallel converting means in the integrated circuit and supplying the gated clock signal to said serial/parallel converting means in the integrated circuit;

a means for generating a first heating operation permitting signal by obtaining the logical NOT of said serial/parallel conversion permitting signal supplied from said serial/parallel converting means in the integrated circuit;

a means for generating second heating operation permitting signal by obtaining the exclusive OR of said second select signal and a second fixed value; and a heating operation permitting means for permitting the selective power supplying operation of said power supplying means by gating said strobe signal in accordance with said first heating operation permitting signal and said second heating operation permitting signal supplied from said first heating operation permitting signal generating means and said second heating operation permitting signal generating means in the integrated circuit and supplying the gated strobe signal to said power supplying means in the integrated circuit;

said serial/parallel converting means in each integrated circuit executes the serial/parallel conversion only when said serial/parallel conversion is permitted by said serial/parallel conversion permitting means in the integrated circuit; and said power supplying means in the integrated circuit executes the selective power supplying operation only when the selective power supplying operation is permitted by said heating operation permitting means in the integrated circuit.

59. A thermal head according to claim 58, wherein each integrated circuit further comprises a pullup resistor for supplying said first fixed value.

60. A thermal head according to claim 58, wherein each integrated circuit further comprises a pullup resistor for supplying said second fixed value.

61. A thermal head according to claim 44, wherein said input selecting means includes a means for fixing the potential of at least one of said select signal input terminals within the corresponding integrated circuit.

* * * * *